US012181256B2

(12) United States Patent
Nemtyshkin et al.

(10) Patent No.: US 12,181,256 B2
(45) Date of Patent: Dec. 31, 2024

(54) PISTON FOR DEPLOYING A PROJECTILE OF A CONDUCTED ELECTRICAL WEAPON

(71) Applicant: Axon Enterprise, Inc., Scottsdale, AZ (US)

(72) Inventors: Oleg Nemtyshkin, Scottsdale, AZ (US); Dubravko Zekanovic, Scottsdale, AZ (US); Michael Roberts, San Francisco, CA (US); John Groff, San Francisco, CA (US); Mark Summers, Phoenix, AZ (US); Magne H. Nerheim, Paradise Valley, AZ (US); Regan T. Morrison, Phoenix, AZ (US)

( * ) Notice: Subject to any disclaimer, the term of this patent is extended or adjusted under 35 U.S.C. 154(b) by 19 days.

(21) Appl. No.: 17/873,039

(22) Filed: Jul. 25, 2022

(65) Prior Publication Data

US 2023/0148190 A1 May 11, 2023

Related U.S. Application Data

(60) Provisional application No. 63/226,076, filed on Jul. 27, 2021.

(51) Int. Cl.
*F41H 13/00* (2006.01)
*F42B 5/02* (2006.01)

(52) U.S. Cl.
CPC ..... *F41H 13/0025* (2013.01); *F42B 5/02* (2013.01)

(58) Field of Classification Search
CPC .... F42B 5/02; F42B 5/08; F42B 5/045; F42B 8/00; F42B 8/02; F42B 8/12; F42B 12/02; F42B 12/36; F42B 12/362; F42B 12/54; F42B 14/00; F42B 7/08; F41H 13/00; F41H 13/0012; F41H 13/0025; F41H 13/0031; F42C 19/12
USPC ..... 102/430, 447, 502
See application file for complete search history.

(56) References Cited

U.S. PATENT DOCUMENTS

| | | | |
|---|---|---|---|
| 2,685,383 | A | 8/1954 | Kochner |
| 2,926,566 | A | 3/1960 | Atkins et al. |
| 3,440,797 | A | 4/1969 | Spielman |
| 3,803,463 | A | 4/1974 | Cover |
| 4,253,132 | A | 2/1981 | Cover |
| 5,831,199 | A | 11/1998 | McNulty, Jr. et al. |

(Continued)

FOREIGN PATENT DOCUMENTS

| | | | |
|---|---|---|---|
| CN | 1818532 | A | 8/2006 |
| CN | 104613811 | A | 5/2015 |

(Continued)

OTHER PUBLICATIONS

Machine translation of RU-2722278-C2 (Year: 2020).*

(Continued)

*Primary Examiner* — James S Bergin
(74) *Attorney, Agent, or Firm* — Justin Powley

(57) ABSTRACT

A cartridge for a conducted electrical weapon may comprise a body having a first end opposite a second end and an outer surface opposite an inner surface. A cartridge inner assembly may be removably disposed within the body. The cartridge inner assembly may comprise a propulsion module, a plug, a piston, and/or a retaining clip. The cartridge inner assembly may be configured to cause deployment of an electrode. The electrode may be mechanically and electrically coupled to the piston.

20 Claims, 10 Drawing Sheets

(56) References Cited

U.S. PATENT DOCUMENTS

| | | | | |
|---|---|---|---|---|
| 6,161,598 | A | 12/2000 | Eder et al. | |
| 6,877,434 | B1 | 4/2005 | McNulty, Jr. | |
| 7,042,696 | B2 | 5/2006 | Smith et al. | |
| 7,234,262 | B2 | 6/2007 | Smith | |
| 7,327,549 | B2 | 2/2008 | Smith et al. | |
| 7,444,939 | B2 | 11/2008 | McNulty et al. | |
| 7,444,940 | B2 | 11/2008 | Kapeles et al. | |
| 7,950,176 | B1 | 5/2011 | Nemtyshkin et al. | |
| 7,950,329 | B1 | 5/2011 | Nemtyshkin et al. | |
| 7,984,676 | B1 | 7/2011 | Gavin et al. | |
| 8,074,573 | B1 | 12/2011 | Linker | |
| 8,339,763 | B2 | 12/2012 | McNulty et al. | |
| 8,342,098 | B2 | 1/2013 | Shalev et al. | |
| 8,837,107 | B2 | 9/2014 | Hinz | |
| 8,896,892 | B2 | 11/2014 | Wen | |
| 9,435,619 | B1 | 9/2016 | Park | |
| 9,638,498 | B2 | 5/2017 | Chang | |
| 10,066,905 | B2 | 9/2018 | Heroor et al. | |
| 10,161,722 | B1 | 12/2018 | Salisbury et al. | |
| 10,168,127 | B1 * | 1/2019 | Salisbury | F41H 13/0025 |
| 10,598,467 | B1 | 3/2020 | McDermit et al. | |
| 10,731,953 | B2 | 8/2020 | Petrovic et al. | |
| 11,041,698 | B2 | 6/2021 | Nemtyshkin et al. | |
| 2005/0109200 | A1 | 5/2005 | McNulty | |
| 2006/0187610 | A1 | 8/2006 | Su | |
| 2006/0207466 | A1 | 9/2006 | McNulty et al. | |
| 2006/0254108 | A1 | 11/2006 | Park | |
| 2006/0279898 | A1 | 12/2006 | Smith et al. | |
| 2007/0019357 | A1 | 1/2007 | Keely | |
| 2007/0214993 | A1 | 9/2007 | Cerovic et al. | |
| 2010/0050856 | A1 | 3/2010 | Baldwin | |
| 2010/0275806 | A1 | 11/2010 | Gavin et al. | |
| 2012/0019975 | A1 | 1/2012 | Hanchett et al. | |
| 2012/0170167 | A1 | 7/2012 | Beechey et al. | |
| 2014/0233146 | A1 | 8/2014 | Gavin | |
| 2014/0293499 | A1 | 10/2014 | Beechey et al. | |
| 2015/0002981 | A1 | 1/2015 | Klug et al. | |
| 2015/0153144 | A1 | 6/2015 | Cheatham, III et al. | |
| 2015/0329341 | A1 | 11/2015 | Wilder et al. | |
| 2016/0010956 | A1 | 1/2016 | Hanchett | |
| 2016/0010957 | A1 | 1/2016 | Beechey et al. | |
| 2016/0279433 | A1 | 9/2016 | Cheatham, III et al. | |
| 2017/0059661 | A1 | 3/2017 | Foldyna | |
| 2017/0258583 | A1 | 9/2017 | McCawley et al. | |
| 2017/0304639 | A1 | 10/2017 | Cheatham, III et al. | |
| 2018/0283829 | A1 | 10/2018 | Petrovic et al. | |
| 2019/0128650 | A1 | 5/2019 | Kim | |
| 2019/0178617 | A1 | 6/2019 | Brydges-Price | |
| 2020/0109933 | A1 | 4/2020 | Brundula et al. | |
| 2020/0284556 | A1 | 9/2020 | Nemtyshkin et al. | |
| 2020/0400416 | A1 | 12/2020 | Brundula et al. | |
| 2022/0082357 | A1 | 3/2022 | Smith et al. | |
| 2022/0228841 | A1 | 7/2022 | Smith et al. | |
| 2023/0036491 | A1 * | 2/2023 | Gish | F41A 21/18 |

FOREIGN PATENT DOCUMENTS

| | | | | |
|---|---|---|---|---|
| CN | 205425968 | U | 8/2016 | |
| CN | 205957818 | U | 2/2017 | |
| CN | 207351302 | U | 5/2018 | |
| CN | 106767174 | B | 8/2018 | |
| CN | 108444337 | A | 8/2018 | |
| EP | 0849770 | A2 | 6/1998 | |
| KR | 101872709 | B1 | 7/2018 | |
| KR | 101890759 | B1 | 8/2018 | |
| RU | 2275576 | C1 | 4/2006 | |
| RU | 68671 | U1 | 11/2007 | |
| RU | 2351871 | C1 | 4/2009 | |
| RU | 2477441 | C1 | 3/2013 | |
| RU | 2480704 | C2 | 4/2013 | |
| RU | 2526159 | C2 | 8/2014 | |
| RU | 2527242 | C2 | 8/2014 | |
| RU | 2648562 | C1 | 3/2018 | |
| RU | 2722278 | C2 * | 5/2020 | F41B 15/04 |
| TW | 201932785 | A | 8/2019 | |
| WO | 20090025575 | A1 | 2/2009 | |
| WO | 2011011365 | A2 | 1/2011 | |
| WO | 2012082012 | A2 | 6/2012 | |
| WO | 2012128670 | A2 | 9/2012 | |
| WO | 2018194701 | A1 | 10/2018 | |
| WO | 2019-147293 | A1 | 8/2019 | |
| WO | 2021101604 | A1 | 5/2021 | |
| WO | WO-2023009456 | A1 * | 2/2023 | F41H 13/0025 |

OTHER PUBLICATIONS

Korean Intellectual Property Office, International Search Report and Written Opinion for International Application No. PCT/US2022/038223 mailed Nov. 17, 2022.

Taiwan Patent Office, Office Action for Taiwan Application No. 111128006 mailed Sep. 27, 2023.

Taiwan Patent Office, Allowance Decision of Examination for Taiwan Application No. 111128006 mailed May 3, 2024.

Canadian Intellectual Property Office, Officer Action for Canadian Application No. 3,174,225 mailed Mar. 20, 2024.

* cited by examiner

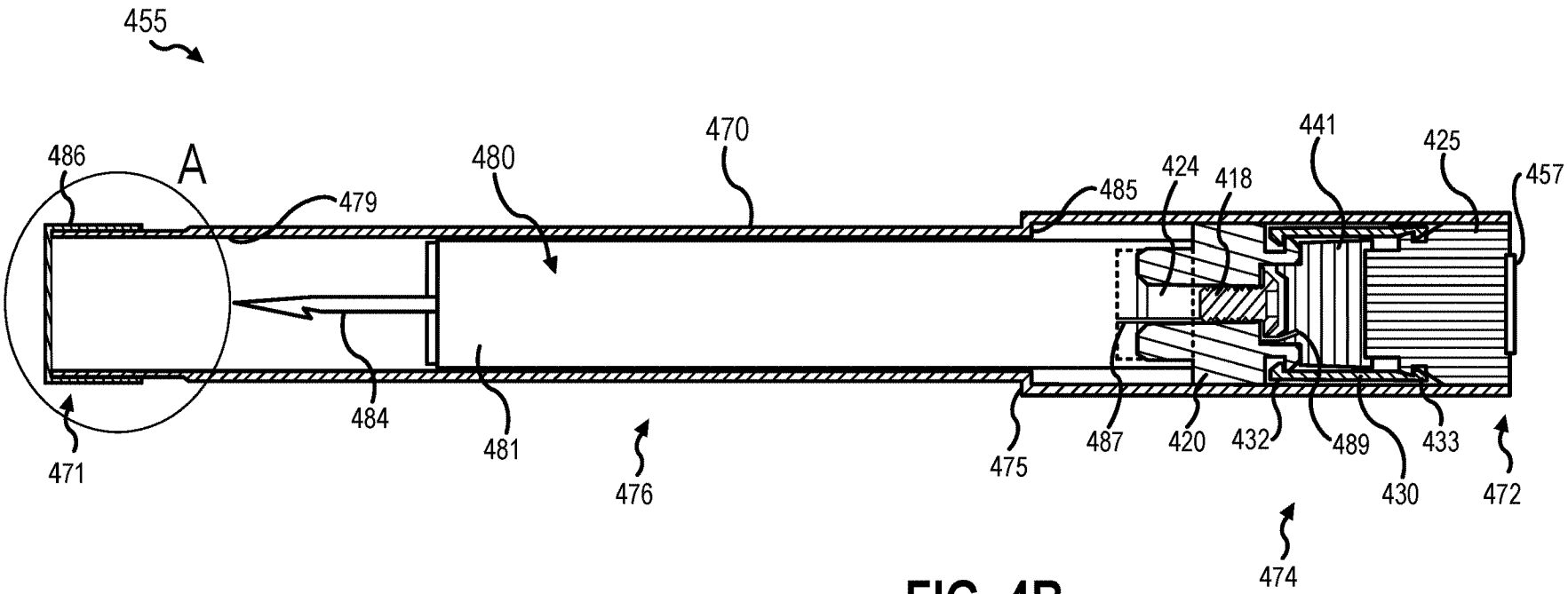
FIG. 4B
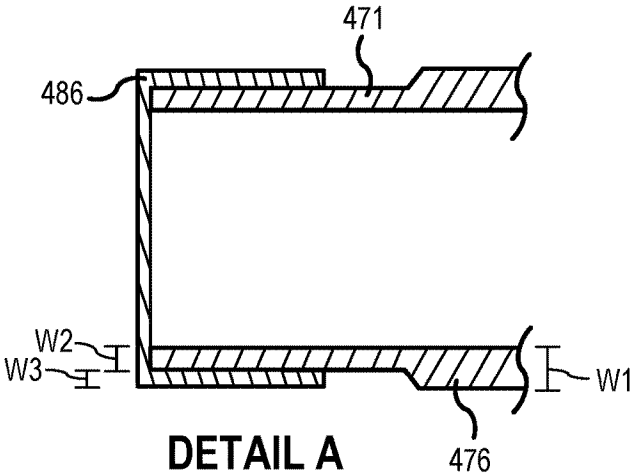
DETAIL A

PISTON FOR DEPLOYING A PROJECTILE OF A CONDUCTED ELECTRICAL WEAPON

FIELD OF THE INVENTION

Embodiments of the present disclosure relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

FIG. 4B is a cross-sectional view of a cartridge, in accordance with various embodiments;

Figure 1:
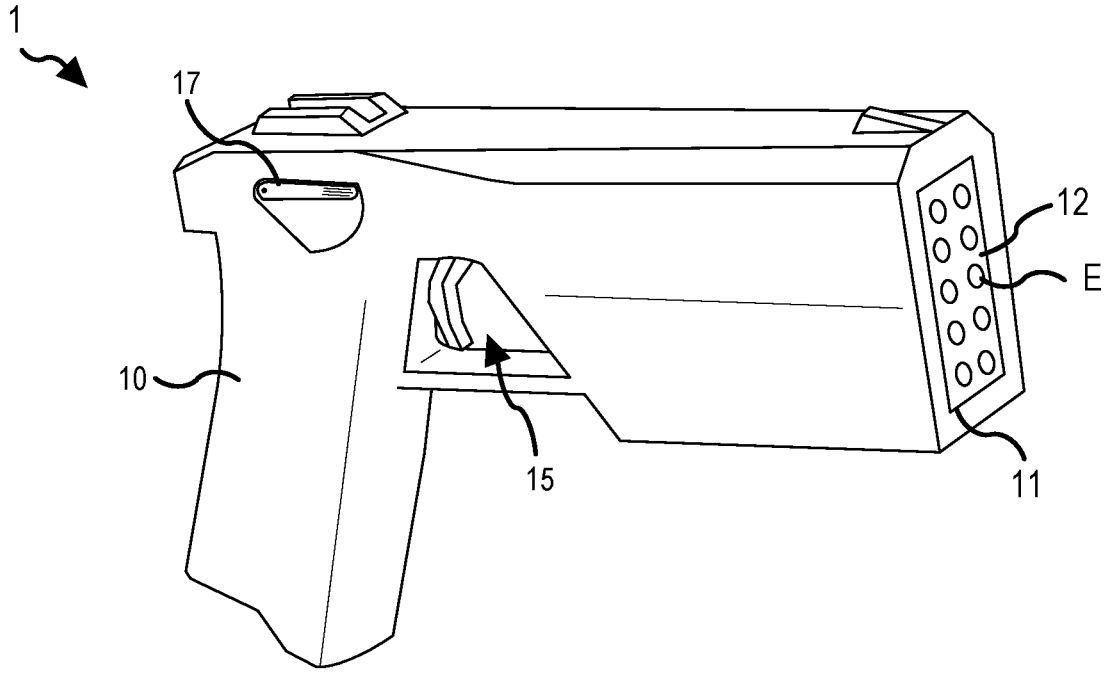
FIG. 1 is a perspective view of a conducted electrical weapon ("CEW"), in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step.

Also, any reference to attached, fixed, coupled, connected, or the like may include permanent, removable, temporary, partial, full, and/or any other possible attachment option. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a magazine. The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines. The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may include two or more electrodes (e.g., projectiles, etc.) that are launched at the same time. In various embodiments, a magazine may include two or more electrodes that may each be launched individually at separate times. In various embodiments, a magazine may include a single electrode configured to be launched from the magazine. Launching the electrodes may be referred to as activating (e.g., firing) a magazine or electrode. In some embodiments, after use (e.g., activation, firing), a magazine may be removed from the bay and the used electrodes may be removed from the magazine and replaced with unused (e.g., not fired, not activated) electrodes. The magazine may be inserted into the bay again to permit launch of additional electrodes. In some embodiments, after use (e.g., activation, firing), a magazine may be removed from the bay and replaced with an unused (e.g., not fired, not activated) magazine to permit launch of additional electrodes.

Figure 2:
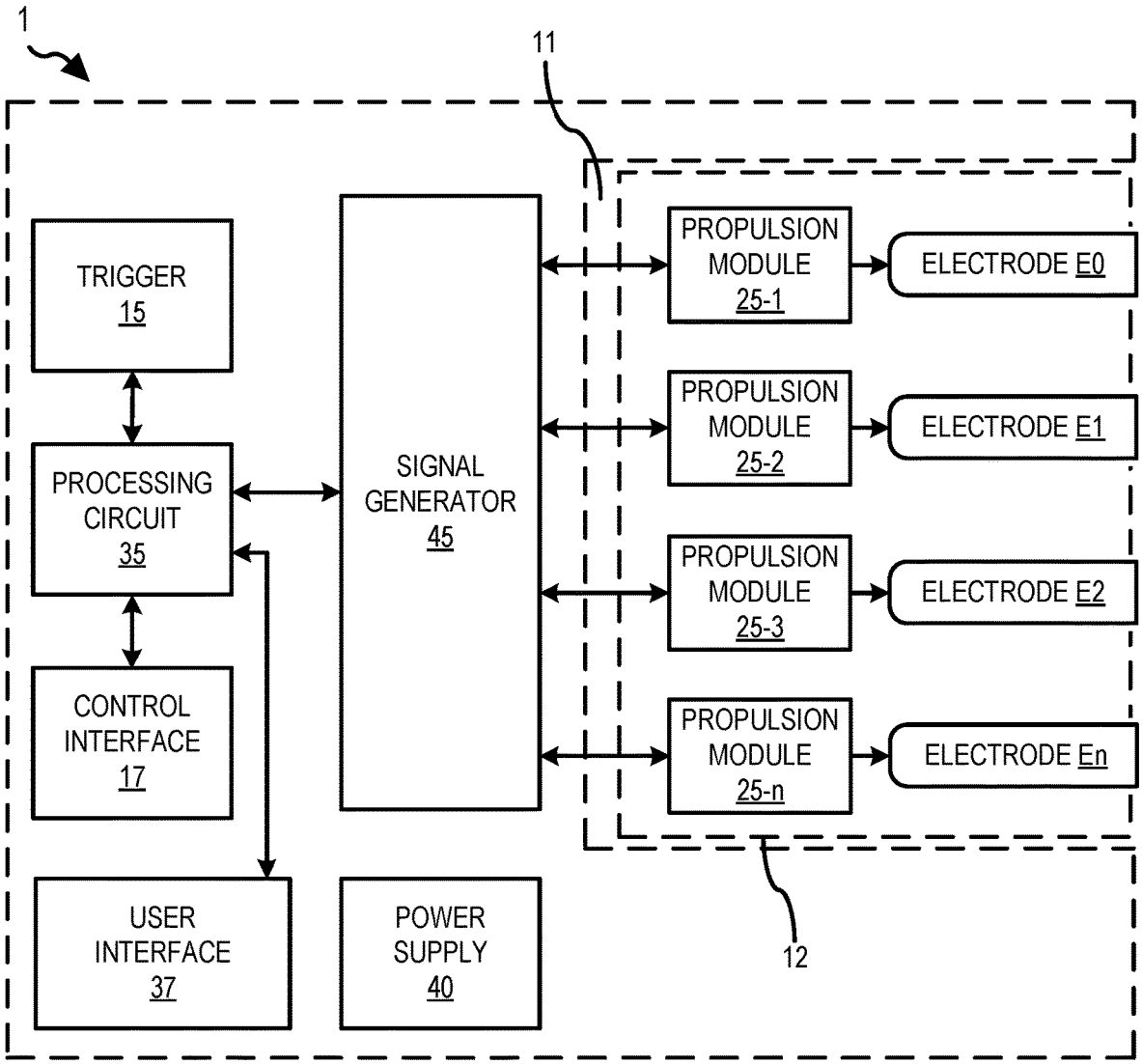
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a housing 10 and a magazine 12. It should be understood by one skilled in the art that FIG. 2 is a schematic representation of CEW 1, and one or more of the components of CEW 1 may be located in any suitable position within, or external to, housing 10.

Housing 10 may be configured to house various components of CEW 1 that are configured to enable deployment of magazine 12, provide an electrical current to magazine 12, and otherwise aid in the operation of CEW 1, as discussed further herein. Although depicted as a firearm in FIG. 1, housing 10 may comprise any suitable shape and/or size. Housing 10 may comprise a handle end opposite a deployment end. A deployment end may be configured, and sized and shaped, to receive one or more magazine 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, housing 10 may comprise various mechanical, electronic, and/or electrical components configured to aid in performing the functions of CEW 1. For example, housing 10 may comprise one or more triggers 15, control interfaces 17, processing circuits 35, power supplies 40, and/or signal generators 45. Housing 10 may include a guard (e.g., trigger guard). A guard may define an opening formed in housing 10. A guard may be located on a center region of housing 10 (e.g., as depicted in FIG. 1), and/or in any other suitable location on housing 10. Trigger 15 may be disposed within a guard. A guard may be configured to protect trigger 15 from unintentional physical contact (e.g., an unintentional activation of trigger 15). A guard may surround trigger 15 within housing 10.

In various embodiments, trigger 15 be coupled to an outer surface of housing 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more magazine 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more magazine 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via magazine 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuitry. Signal conditioning circuitry may include level shifters to change (e.g., increase, decrease) the magnitude of a voltage (e.g., of a signal) before receipt by processing circuit 35 or to shift the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible non-transitory computer-readable memory. Instructions stored on the tangible non-transitory memory may allow processing circuit 35 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1. Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 17. Processing circuit 35 may be configured to detect an activation, actuation, depression, input, etc. (collectively, a "control event") of control interface 17. In response to detecting the control event, processing circuit 35 may be configured to perform various operations and/or functions, as discussed further herein. Processing circuit 35 may also include a sensor (e.g., a control sensor) attached to control interface 17 and configured to detect a control event of control interface 17. The sensor may comprise any suitable mechanical and/or electronic sensor capable of detecting a control event in control interface 17 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 17, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, signal generator 45 may be configured to receive one or more control signals from processing circuit 35. Signal generator 45 may provide an ignition signal to magazine 12 based on the control signals. Signal generator 45 may be electrically and/or electronically coupled to processing circuit 35 and/or magazine 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within housing 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to magazine 12 (or an electrode in magazine 12). For example, signal generator 45 may provide an electrical signal as an ignition signal to magazine 12 in response to receiving a control signal from processing circuit 35. In various embodiments, the ignition signal may be separate and distinct from a stimulus signal. For example, a stimulus signal in CEW 1 may be provided to a different circuit within magazine 12, relative to a circuit to which an ignition signal is provided. Signal generator 45 may be configured to generate a stimulus signal. In various embodiments, a second, separate signal generator, component, or circuit (not shown) within housing 10 may be configured to generate the stimulus signal. Signal generator 45 may also provide a ground signal path for magazine 12, thereby completing a circuit for an electrical signal provided to magazine 12 by signal generator 45. The ground signal path may also be provided to magazine 12 by other elements in housing 10, including power supply 40.

In various embodiments, a bay 11 of housing 10 may be configured (to receive one or more magazine 12. Bay 11 may comprise an opening in an end of housing 10 sized and shaped to receive one or more magazine 12. Bay 11 may include one or more mechanical features configured to removably couple one or more magazine 12 within bay 11. Bay 11 of housing 10 may be configured to receive a single magazine, two magazines, three magazines, nine magazines, or any other number of magazines.

Magazine 12 may comprise one or more propulsion modules 25 and one or more electrodes E. For example, a magazine 12 may comprise a single propulsion module 25 configured to deploy a single electrode E. As a further example, a magazine 12 may comprise a single propulsion module 25 configured to deploy a plurality of electrodes E. As a further example, a magazine 12 may comprise a plurality of propulsion modules 25 and a plurality of electrodes E, with each propulsion module 25 configured to deploy one or more electrodes E. In various embodiments, and as depicted in FIG. 2, magazine 12 may comprise a first propulsion module 25-1 configured to deploy a first electrode E0, a second propulsion module 25-2 configured to deploy a second electrode E1, a third propulsion module 25-3 configured to deploy a third electrode E2, and a fourth propulsion module 25-4 configured to deploy a fourth electrode En. Each series of propulsion modules and electrodes may be contained in the same and/or separate magazines. As referred to herein, electrodes E0, E1, E2, En may be generally referred to individually as an "electrode E" or collectively as "electrodes E." As referred to herein, propulsion modules 25-1, 25-2, 25-3, **25-*n* may be referred to individually as a "propulsion module 25" or collectively as "propulsion modules 25**."

In various embodiments, a propulsion module 25 may be coupled to, or in communication with one or more electrodes E in magazine 12. In various embodiments, magazine 12 may comprise a plurality of propulsion modules 25, with each propulsion module 25 coupled to, or in communication with, one or more electrodes E. A propulsion module 25 may comprise any device, propellant (e.g., air, gas, etc.), primer, or the like capable of providing a propulsion force in magazine 12. The propulsion force may include an increase in pressure caused by rapidly expanding gas within an area or chamber. The propulsion force may be applied to one or more electrodes E in magazine 12 to cause the deployment of the one or more electrodes E. A propulsion module 25 may provide the propulsion force in response to magazine 12 receiving an ignition signal, as previously discussed.

In various embodiments, the propulsion force may be directly applied to one or more electrodes E. For example, a propulsion force from propulsion module 25-1 may be provided directly to first electrode E0. A propulsion module 25 may be in fluid communication with one or more electrodes E to provide the propulsion force. For example, a propulsion force from propulsion module 25-1 may travel within a housing or channel of magazine 12 to first electrode E0. The propulsion force may travel via a manifold in magazine 12.

In various embodiments, the propulsion force may be provided indirectly to one or more electrodes E. For example, the propulsion force may be provided to a secondary source of propellant within propulsion system 125. The propulsion force may launch the secondary source of propellant within propulsion system 125, causing the secondary source of propellant to release propellant. A force associated with the released propellant may in turn provide a force to one or more electrodes E. A force generated by a secondary source of propellant may cause the one or more electrodes E to be deployed from the magazine 12 and CEW 1.

In various embodiments, an electrode E may comprise any suitable type of projectile. For example, one or more electrodes E may be or include a projectile, a probe, an electrode (e.g., an electrode dart), an entangling projectile (e.g., a tether-based entangling projectile, a net, etc.), a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

In various embodiments, magazine 12 may be configured to receive one or more cartridges. For example, magazine 12 may define one or more bores. A bore may comprise an axial opening through magazine 12. Each bore may be configured to receive a cartridge. Each bore may be sized and shaped accordingly to receive and house the cartridge. Each bore may comprise any suitable deployment angle. One or more bores may comprise similar deployment angles. One or more bores may comprise different deployment angles. Magazine 12 may comprise any suitable or desired number of bores, such as, for example, two bores, five bores, nine bores, ten bores, and/or the like.

A cartridge may comprise a body (e.g., a cartridge body) housing an electrode E and one or more components necessary to deploy the electrode E from the body. For example, a cartridge may comprise an electrode E and a propulsion module. The propulsion module may be similar to any other propulsion module, primer, or the like disclosed herein.

In various embodiments, a cartridge may comprise a cylindrical outer body defining a hollow inner portion. The hollow inner portion may house an electrode E (e.g., an electrode E, a spear, filament wire, etc.). The hollow inner portion may house a propulsion module configured to deploy the electrode E from a first end of the cylindrical outer body. The cartridge may include a piston positioned adjacent a second end of the electrode E. The cartridge may have the propulsion module positioned such that the piston is located between the electrode E and the propulsion module. The cartridge may also have a wad positioned adjacent the piston, where the wad is located between the propulsion module and the piston.

In various embodiments, a cartridge may comprise a contact on an end of the body. The contact may be configured to allow the cartridge to receive an electrical signal from a CEW handle. For example, the contact may comprise an electrical contact configured to enable the completion of an electrical circuit between the cartridge and a signal generator of the CEW handle. In that regard, the contact may be configured to transmit (or provide) a stimulus signal from the CEW handle to the electrode E. As a further example, the contact may be configured to transmit (or provide) an electrical signal (e.g., an ignition signal) from the CEW handle to a propulsion module within the cartridge. For example, the contact may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode E from the cartridge.

In operation, a cartridge may be inserted into a bore of magazine 12. Magazine 12 may be inserted into the bay of a CEW handle. The CEW may be operated to deploy an electrode E from the cartridge in magazine 12. Magazine 12 may be removed from the bay of the CEW handle. The cartridge (e.g., a used cartridge, a spent cartridge, etc.) may be removed from the bore of magazine 12. A new cartridge may then be inserted into the same bore of magazine 12 for additional deployments. The number of cartridges that magazine 12 is capable of receiving may be dependent on a number of bores in magazine 12. For example, in response to magazine 12 comprising ten bores, magazine 12 may be configured to receive at most ten cartridges at the same time. As a further example, in response to magazine 12 comprising two bores, magazine 312 may be configured to receive at most two cartridges at the same time.

Control interface 17 of CEW 1 may comprise, or be similar to, any control interface disclosed herein. In various embodiments, control interface 17 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of magazine 12, and/or similar operations, as discussed further herein. In various embodiments, control interface 17 may also be configured to perform (or cause performance of) one or more operations that do not include the selection of firing modes. For example, control interface 17 may be configured to enable the selection of operating modes of CEW 1, selection of options within an operating mode of CEW 1, or similar selection or scrolling operations, as discussed further herein.

Control interface 17 may be located in any suitable location on or in housing 10. For example, control interface 17 may be coupled to an outer surface of housing 10. Control interface 17 may be coupled to an outer surface of housing 10 proximate trigger 15 and/or a guard of housing 10. Control interface 17 may be electrically, mechanically, and/or electronically coupled to processing circuit 35. In various embodiments, in response to control interface 17 comprising electronic properties or components, control interface 17 may be electrically coupled to power supply 40. Control interface 17 may receive power (e.g., electrical current) from power supply 40 to power the electronic properties or components.

Control interface 17 may be electronically or mechanically coupled to trigger 15. For example, and as discussed further herein, control interface 17 may function as a safety mechanism. In response to control interface 17 being set to a "safety mode," CEW 1 may be unable to launch electrodes from magazine 12. For example, control interface 17 may provide a signal (e.g., a control signal) to processing circuit 35 instructing processing circuit 35 to disable deployment of electrodes from magazine 12. As a further example, control interface 17 may electronically or mechanically prohibit trigger 15 from activating (e.g., prevent or disable a user from depressing trigger 15; prevent trigger 15 from launching an electrode; etc.).

Control interface 17 may comprise any suitable electronic or mechanical component capable of enabling selection of firing modes. For example, control interface 17 may comprise a fire mode selector switch, a safety switch, a safety catch, a rotating switch, a selection switch, a selective firing mechanism, and/or any other suitable mechanical control. As a further example, control interface 17 may comprise a slide, such as a handgun slide, a reciprocating slide, or the like. As a further example, control interface 17 may comprise a touch screen, user interface or display, or similar electronic visual component.

The safety mode may be configured to prohibit deployment of an electrode from magazine 12 in CEW 1. For example, in response to a user selecting the safety mode, control interface 17 may transmit a safety mode instruction to processing circuit 35. In response to receiving the safety mode instruction, processing circuit 35 may prohibit deployment of an electrode from magazine 12. Processing circuit 35 may prohibit deployment until a further instruction is received from control interface 17 (e.g., a firing mode instruction). As previously discussed, control interface 17 may also, or alternatively, interact with trigger 15 to prevent activation of trigger 15. In various embodiments, the safety mode may also be configured to prohibit deployment of a stimulus signal from signal generator 45, such as, for example, a local delivery.

The firing mode may be configured to enable deployment of one or more electrodes from magazine 12 in CEW 1. For example, and in accordance with various embodiments, in response to a user selecting the firing mode, control interface 17 may transmit a firing mode instruction to processing circuit 35. In response to receiving the firing mode instruction, processing circuit 35 may enable deployment of an electrode from magazine 12. In that regard, in response to trigger 15 being activated, processing circuit 35 may cause the deployment of one or more electrodes. Processing circuit 35 may enable deployment until a further instruction is received from control interface 17 (e.g., a safety mode instruction). As a further example, and in accordance with various embodiments, in response to a user selecting the firing mode, control interface 17 may also mechanically (or electronically) interact with trigger 15 of CEW 1 to enable activation of trigger 15.

In various embodiments, CEW 1 may deliver a stimulus signal via a circuit that includes signal generator 45 positioned in the handle of CEW 1. An interface (e.g., cartridge interface, magazine interface, etc.) on each magazine 12 inserted into housing 10 electrically couples to an interface (e.g., handle interface, housing interface, etc.) in handle housing 10. Signal generator 45 couples to each magazine 12, and thus to the electrodes E, via the handle interface and the magazine interface. A first filament couples to the interface of the magazine 12 and to a first electrode. A second filament couples to the interface of the magazine 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in housing 10. For example, user interface 37 may be coupled to an outer surface of housing 10, or extend at least partially through the outer surface of housing 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3A:
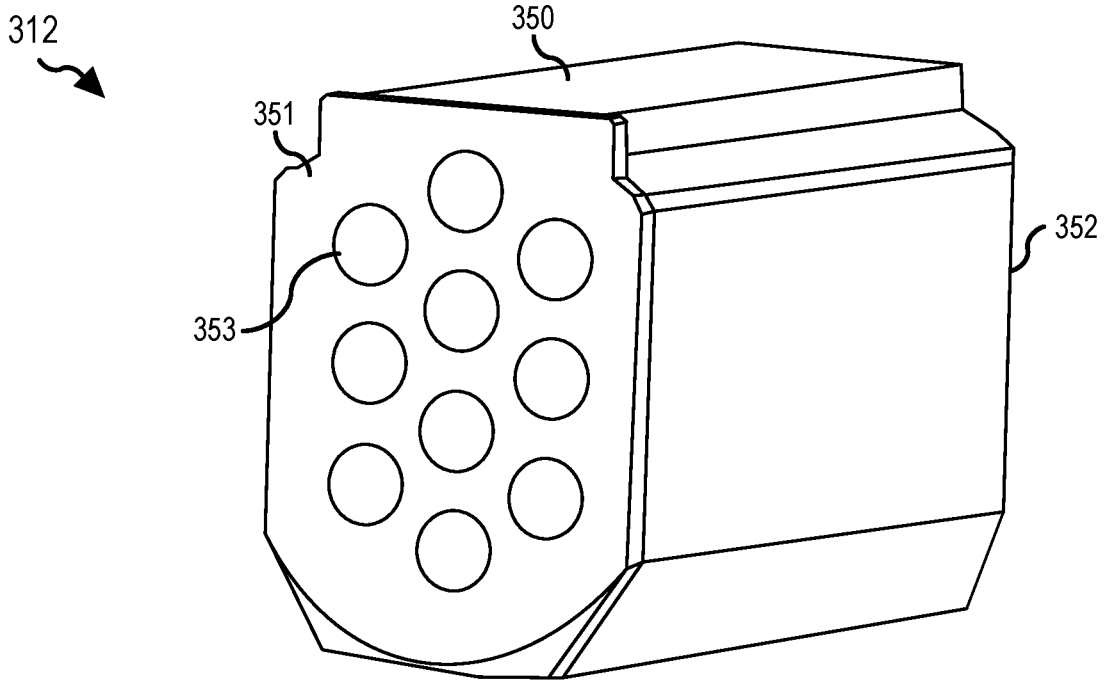
FIG. 3A is a front perspective view of a magazine for a CEW, in accordance with various embodiments.
Figure 3B:
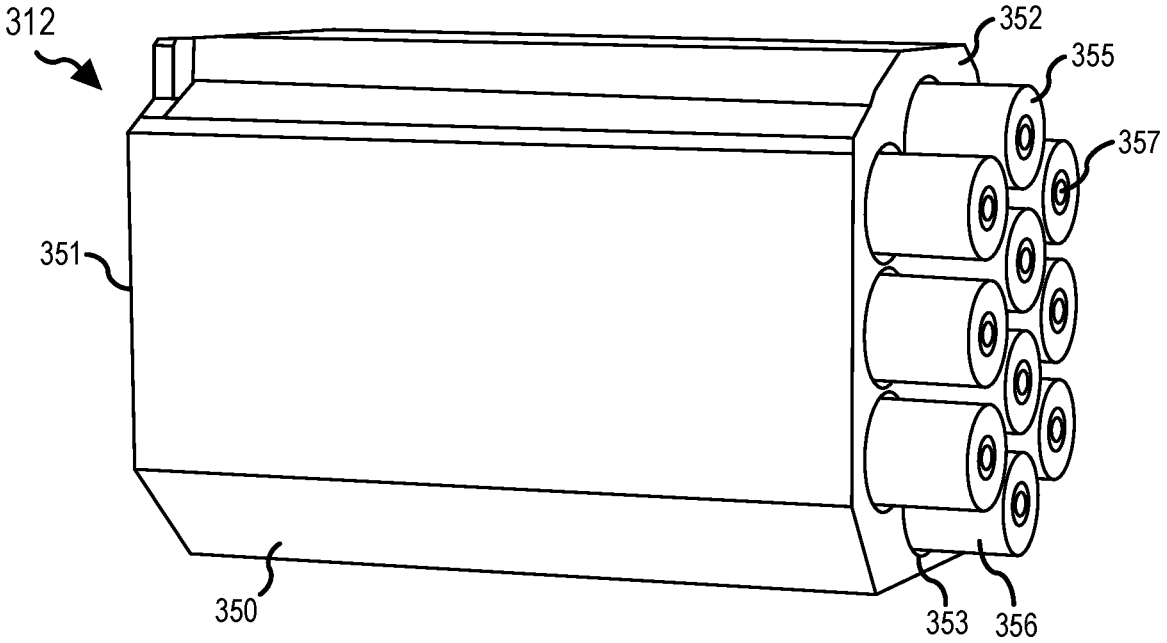
FIG. 3B is a rear perspective view of a magazine for a CEW, in accordance with various embodiments.

In various embodiments, and with reference to FIGS. 3A and 3B, a magazine 312 for a CEW is disclosed. Magazine 312 may be similar to any other magazine or the like disclosed herein.

Magazine 312 may comprise a housing 350 sized and shaped to be inserted into the bay of a CEW handle, as previously discussed. Housing 350 may comprise a first end 351 (e.g., a deployment end, a front end, etc.) opposite a second end 352 (e.g., a loading end, a rear end, etc.). Magazine 312 may be configured to permit launch of one or more electrodes from first end 351 (e.g., electrodes are launched through first end 351). Magazine 312 may be configured to permit loading of one or more electrodes from second end 351. Second end 351 may also be configured to permit provision of stimulus signals from the CEW to the one or more electrodes. In some embodiments, magazine 312 may also be configured to permit loading of one or more electrodes from first end 351.

In various embodiments, housing 350 may define one or more bores 353. A bore 353 may comprise an axial opening through housing 350, defined and open on first end 351 and/or second end 352. Each bore 353 may be configured to receive an electrode (or cartridge containing an electrode). Each bore 353 may be sized and shaped accordingly to receive and house an electrode (or cartridge containing an electrode) prior to and during deployment of the electrode from magazine 312. Each bore 353 may comprise any suitable deployment angle. One or more bores 353 may comprise similar deployment angles. One or more bores 353 may comprise different deployment angles. Housing 350 may comprise any suitable or desired number of bores 353, such as, for example, two bores, five bores, nine bores, ten bores (e.g., as depicted), and/or the like.

In various embodiments, magazine 312 may be configured to receive one or more cartridges 355. A cartridge 355 may comprise a body 356 housing an electrode and one or more components necessary to deploy the electrode from body 356. For example, cartridge 355 may comprise an electrode and a propulsion module. The electrode may be similar to any other electrode, projectile, or the like disclosed herein. The propulsion module may be similar to any other propulsion module, primer, or the like disclosed herein.

In various embodiments, cartridge 355 may comprise a cylindrical outer body 356 defining a hollow inner portion. The hollow inner portion may house an electrode (e.g., an electrode, a spear, filament wire, etc.), or any other projectile disclosed herein. The hollow inner portion may house a propulsion module configured to deploy the electrode from a first end of the cylindrical outer body 356. Cartridge 355 may include a piston positioned adjacent a second end of the electrode. Cartridge 355 may have the propulsion module positioned such that the piston is located between the electrode and the propulsion module. Cartridge 355 may also have a wad positioned adjacent the piston, where the wad is located between the propulsion module and the piston.

In various embodiments, a cartridge 355 may comprise a contact 357 on an end of body 356. Contact 357 may be configured to allow cartridge 355 to receive an electrical signal from a CEW handle. For example, contact 357 may comprise an electrical contact configured to enable the completion of an electrical circuit between cartridge 355 and a signal generator of the CEW handle. In that regard, contact 357 may be configured to transmit (or provide) a stimulus signal from the CEW handle to the electrode. As a further example, contact 357 may be configured to transmit (or provide) an electrical signal (e.g., an ignition signal) from the CEW handle to a propulsion module within the cartridge 355. For example, contact 357 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 355.

In operation, a cartridge 355 may be inserted into a bore 353 of a magazine 312. The magazine 312 may be inserted into the bay of a CEW handle. The CEW may be operated to deploy an electrode from the cartridge 355 in magazine 312. Magazine 312 may be removed from the bay of the CEW handle. The cartridge 355 (e.g., a used cartridge, a spent cartridge, etc.) may be removed from the bore 353 of magazine 312. A new cartridge 355 may then be inserted into the same bore 353 of magazine 312 for additional deployments. The number of cartridges 355 that magazine 312 is capable of receiving may be dependent on a number of bores 353 in housing 350. For example, in response to housing 350 comprising ten bores 353, magazine 312 may be configured to receive at most ten cartridges 355 at the same time. As a further example, in response to housing 350 comprising two bores 353, magazine 312 may be configured to receive at most two cartridges 355 at the same time.

Figure 4A:
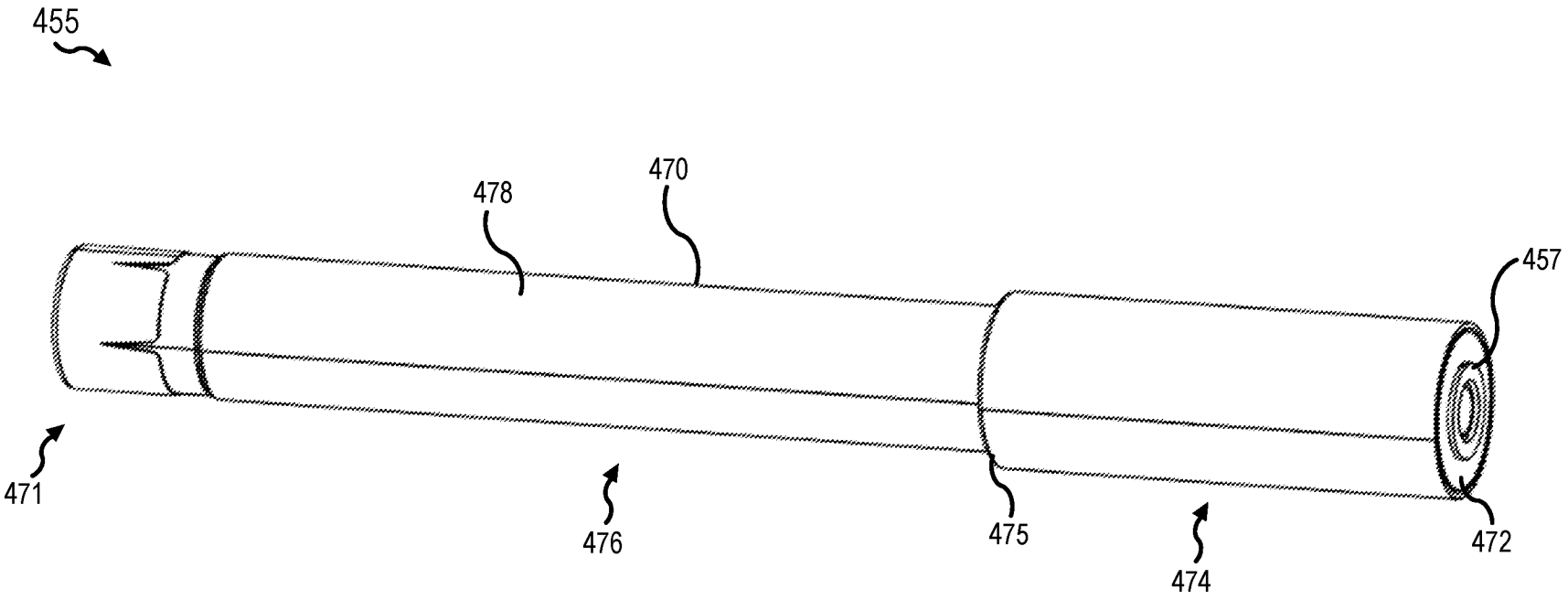
FIG. 4A is a perspective view of a cartridge, in accordance with various embodiments.

In various embodiments, and with reference to FIGS. 4A and 4B, a cartridge 455 is disclosed. Cartridge 455 may be similar to any other cartridge disclosed herein. Cartridge 455 may comprise a body 470 (e.g., a cartridge body) having a first end 471 (e.g., a deployment end, a first cartridge end, etc.) opposite a second end 472 (e.g., a contact end, a second cartridge end, etc.). Body 470 may comprise a cylindrical shape. Body 470 may comprise a monolithic structure, or may comprise separate structures coupled together to form a singular body.

In various embodiments, body 470 may comprise a wide portion 474 (e.g., a base) and an elongated portion 476 (e.g., a firing tube, bore, etc.). Wide portion 474 may define second end 472. Elongated portion 476 may define first end 471. Body 470 may define a step 475 between (and separating) wide portion 474 and elongated portion 476. Step 475 may define an outer surface of body 470 extending radially inward relative to wide portion 474. Step 475 may define an outer surface of body 470 extending radially outward relative to elongated body 476. In that regard, wide portion 474 may define a portion of body 470 from second end 452 to step 475 and elongated portion 476 may define a portion of body 470 from first end 471 to step 475.

Wide portion 474 and elongated portion 476 may comprise different dimensions. For example, wide portion 474 may comprise a first width (e.g., a first cartridge width) and a first length (e.g., a first cartridge length). Elongated portion 476 may comprise a second width (e.g., a second cartridge width) and a second length (e.g., a second cartridge length). The first width may be greater than the second width (e.g., the second width may be less than the first width). The first length may be less than the second length (e.g., the second length may be greater than the first length).

Wide portion 474 may comprise a consistent inner diameter from first end 471 to step 475. Elongated portion 476 may comprise a consistent inner diameter from step 475 to second end 472. The consistent diameter of wide portion 474 may be greater than the consistent diameter of elongated portion 476.

Elongated portion 476 may comprise a varying outer diameter. For example, a first portion (e.g., a first body portion) of elongated portion 476 proximate first end 471 may comprise a smaller outer diameter than a second portion (e.g., a second body portion) of elongated portion 476 proximate step 475. For example, the first portion may comprise a first outer diameter and the second portion may comprise a second outer diameter. The second outer diameter may be greater than the first outer diameter. Wide portion 474 may define a third portion (e.g., a third body portion) comprising a third outer diameter. The third outer diameter may be greater than each of the second outer diameter and the first outer diameter.

In some embodiments, the first portion may comprise a first inner diameter and the second portion may comprise a second inner diameter. The first inner diameter may be the same, or substantially the same, as the second inner diameter. The third portion may comprise a third inner diameter. The third inner diameter may be greater than each of the first inner diameter and the second inner diameter.

In some embodiments, the first portion and the second portion may define equal parts of elongated portion 476. In some embodiments, the first portion may be smaller in length than the second portion. For example, the first portion may comprise a percentage of the length of the second portion such as 70%, 60%, 50%, 30%, 20%, 10%, and/or the like.

The varying outer diameter between the first portion and the second portion of elongated portion 476 may define a step (e.g., a second step, a blast door step, etc.). The step may define a change in outer diameter between different portions of elongated body 476.

In various embodiments, body 470 may comprise an outer surface 478 opposite an inner surface 479. Outer surface 478 may be configured to contact a bore of a magazine in response to being inserted into the magazine. Inner surface 479 may define an opening (e.g., a bore, a barrel, etc.) through body 470 configured to retain a projectile and one or more components configured to cause deployment of the projectile, such as, for example, a cartridge inner assembly.

In various embodiments, inner surface 479 of body 470 may define a piston stop 485 between (and separating) wide portion 474 and elongated portion 476. Piston stop 485 may define an inner surface of body 470 extending radially inward relative to wide portion 474. Piston stop 485 may define an inner surface of body 470 extending radially outward relative to elongated body 476. Piston stop 485 may define an inner surface portion of body 470 opposite step 475.

In various embodiments, cartridge 455 may comprise a blast door 486 configured to at least partially obstruct first end 471 prior to a deployment of a projectile from cartridge 455. Blast door 486 may be coupled to first end 571. Blast door 486 may be configured to at least partially obstruct first end 451 prior to deployment of a projectile from cartridge 455. In response to deployment of the projectile, blast door 486 may decouple from first end 451. For example, blast door 486 may decouple from first end 471 responsive to contact and a force from the projectile. Blast door 486 may couple to the projectile (e.g., via spear 484 of electrode 480) in response to the contact and the force. Blast door 486 may decouple and become dislodged from first end 471 without coupling to the projectile (e.g., blast door 486 may move from the trajectory of the projectile in response to decoupling from first end 471). In other embodiments, a force causing deployment of the projectile from cartridge 455 may decouple blast door 486 without contact or a force from the projectile.

Blast door 486 may be coupled to elongated portion 476 (e.g., first portion of elongated portion 476). Blast door 486 may extend axially aft first end 471 towards a second portion of elongated 476 (e.g., towards step 475, second end 472, etc.). Blast door 486 may decouple from elongated portion 476 during a deployment.

In various embodiments, a portion of body 470 proximate first end 471 may be sized and shaped to receive blast door 486. In that regard, the portion of body 470 proximate first end 471 may comprise different dimensions (e.g., varying dimensions) compared to a remainder of elongated portion 476. For example, the portion of body 470 proximate 471 may comprise an inner diameter substantially similar to the remainder of elongated portion 476, but an outer diameter smaller than the remainder of elongated portion 476 (e.g., a first outer diameter of elongated portion 476 is greater than a second outer diameter of body 470 proximate first end 471).

For example, and in accordance with various embodiments, DETAIL A of FIG. 4B depicts associated widths (e.g., thicknesses, wall diameters, etc.) of elongated portion 476, first end 471, and blast door 486. Elongated portion 476 may comprise a first width W1. First end 471 of body 470 may comprise a second width W2. Blast door 486 may comprise a third width W3. In some embodiments, blast door 486 may comprise varying widths (e.g., a third width, a fourth width, etc.). For example, a width of a first portion of blast door 486 obstructing the opening of first end 471 may be different from a width of a second portion (e.g., each end portion of blast door 486) coupled to first end 471 of body 470. As a further example, a width of a first portion of blast door 486 obstructing the opening of first end 471 may be greater than a width of a second portion (e.g., each end portion of blast door 486) coupled to first end 471 of body 470. As a further example, a width of a first portion of blast door 486 obstructing the opening of first end 471 may be less than a width of a second portion (e.g., each end portion of blast door 486) coupled to first end 471 of body 470.

First width W1 may be greater than second width W2. First width W1 may be greater than third width W3. First width W1 may be greater than second width W2 together with third width W3. First width W1 may be substantially similar to, or equal to, second width W2 together with third width W3. In some embodiments, elongated portion 476 having a first width W1 greater than, substantially similar to, or equal to second width W2 together with third width W3 ensures that cartridge 455 may be properly received within a bore of a magazine without blast door 486 interfering with (or obstructing) the inner surface of the bore of the magazine.

Second width W2 may be greater than third width W3. Third width W3 may be less than second width W2. Second width W2 may be substantially similar to, or equal to, third width W3.

In some embodiments, blast door 486 may be configured to hermitically seal cartridge 455 at first end 471. In some embodiments, blast door 486 may be configured to at least partially seal internal components of cartridge 455 from the environment external body 470.

In various embodiments, a projectile disposed within cartridge 455 may comprise an electrode 480. Electrode 480 may comprise any electrode, projectile, or the like disclosed herein. For example, although depicted as an electrode for a CEW, electrode 480 may alternatively comprise a projectile such as a lethal payload, a less-lethal payload, a non-lethal payload, a rubber bullet, a standard electrode, an article penetrating electrode, an entangling projectile (e.g., a tether-based entangling projectile, a net, etc.), a scent-based projectile, a pepper spray projectile (e.g., oleoresin capsicum, OC spray), a tear gas projectile (e.g., 2-chlorobenzalmalononitrile, CS spray), and/or the like.

In various embodiments, electrode 480 may comprise a body 481 (e.g., an electrode body). Electrode 480 may comprise a spear 484 coupled to a forward-end of electrode 480. Electrode 480 may be disposed within body 470 (e.g., cartridge body) and configured to deploy from first end 471.

In various embodiments, electrode 480 may comprise a filament 487 (e.g., a wire-tether) configured to mechanically and/or electrically couple electrode 480 to cartridge 455 before, during, and/or after deployment of electrode 480. For example, electrode 480 may be in electrical series with filament 487, body 470, and/or a signal generator of a CEW handle. Filament 487 may comprise a first end coupled to electrode 480 and a second end 489 coupled to cartridge 455 (or a component of or within cartridge 455).

In various embodiments, cartridge 455 may comprise a contact 457 disposed proximate (or on) second end 472. Contact 457 may be similar to any other contact disclosed herein. Contact 457 may be configured to allow cartridge 455 to receive an electrical signal from a CEW handle. For example, contact 457 may comprise an electrical contact configured to enable the completion of an electrical circuit between cartridge 455 and a signal generator of the CEW handle. In that regard, contact 457 may be configured to transmit (or provide) a stimulus signal from the CEW handle to one or more components within cartridge 455. As a further example, contact 457 may be configured to transmit (or provide) an electrical signal (e.g., an ignition signal) from the CEW handle to a propulsion module within cartridge 455. For example, contact 457 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 455.

In some embodiments, contact 457 may be configured to receive a first electrical signal from the CEW handle and body 470 may be configured to receive a second electrical signal from the CEW handle. For example, in some embodiments, the first electrical signal may comprise an ignition signal configured to cause deployment of a projectile from cartridge 455. The second electrical signal may comprise a stimulus signal configured to be provided through the projectile, via body 470. In that regard, body 470 may be in electrical series with the projectile and the CEW handle, as disclosed further herein. As a further example, and in accordance with some embodiments, contact 457 may be configured to interface with a signal pin of a CEW handle and body 470 may be configured to interface with a ground pin of the CEW handle.

In various embodiments, cartridge 455 may comprise a cartridge inner assembly. The cartridge inner assembly may comprise one or more components configured to aid in deploying a projectile from cartridge 455, providing a stimulus signal through the projectile, and/or the like. For example, the cartridge inner assembly may comprise one or more of a propulsion module, a plug, a piston, and/or a retaining clip. In some embodiments, a cartridge inner assembly may further comprise a wad.

In various embodiments, cartridge 455 may comprise a propulsion module 425 disposed within body 470. Propulsion module 425 may be configured to provide a propulsive force to cause deployment of a projectile from cartridge 455. Propulsion module 425 may be similar to any other propulsion module disclosed herein. In some embodiments, propulsion module 425 may be similar to a propulsion module, propulsion device, and/the like described in U.S. patent application Ser. No. 16/153,640 filed on Oct. 5, 2018, which is hereby incorporated by reference in its entirety.

In various embodiments, propulsion module 425 may comprise any type of device that may be controlled to provide a rapidly expanding gas. Propulsion module 425 may be ignited to launch a projectile from cartridge 455. For example, propulsion module 425 may comprise a primer. The primer may be ignited in any manner, such as by a striking (e.g., percussion) movement that directly or indirectly contacts the primer or electrically by passing a current through the primer. When electrically ignited, the electrical current may comprise a direct current or an alternating current. In some embodiments, the electrical current for igniting a primer may be a pulsed current or a current provided as a step function. The polarity of the current may be positive or negative.

For example, in some embodiments, the primer may be ignited via a mechanical striking force. For example, a mechanical striking force may be applied to contact 457. The striking force may be transferred by contact 457 to propulsion module 425. The striking force may pierce (e.g., penetrate) and/or crush (e.g., compress) the primer in propulsion module 425 thereby causing (e.g., initiating) a chemical reaction in the primer that causes the pyrotechnic material of the primer to burn (e.g., ignite). The burning of the primer produces a rapidly expanding gas. The striking force may be provided by any object such as, for example, a firing pin.

In other embodiments, propulsion module 425 may be ignited via an electrical current. For example, a current may be provided to contact 457. Contact 457 may include electrical paths (e.g., conductors) that permit the current to flow through contact 457 to propulsion module 425. Contact 457 may include mechanical structures that include electrical paths to the primer in propulsion module 425. Flow of a current to the primer may cause a conductor to heat up thereby igniting the pyrotechnic material inside the primer. An electrical path for the current may include contact 457, propulsion module 425, and/or body 470. For example, body 470 may be grounded and a voltage having a positive or negative polarity may be applied to contact 457 to induce a current to flow through contact 457 to propulsion module 425. Igniting the pyrotechnic material in the primer of propulsion module 425 produces a rapidly expanding gas configured to deploy the projectile.

In various embodiments, cartridge 455 may comprise a piston 420 disposed within body 470. Piston 420 may be disposed within body 470 forward of propulsion module 425. Piston 420 may be configured to move in a forward direction (e.g., towards first end 471) responsive to the propulsive force from propulsion module 425. As piston 420 moves in the forward direction, piston 420 contacts piston stop 485 causing piston 420 to cease moving forward. Movement of piston 420 may apply a forward force on a rear-end portion of electrode 480 causing electrode 480 to move in the forward direction. Forward movement of electrode 480 does not cease when piston 420 contacts piston stop 485. Electrode 480 continues to move in a forward direction to exit body 470 to travel toward a target and provide a stimulus signal through the target.

Piston 420 may comprise a body having a forward end (e.g., first end) opposite an aft end (e.g., second end). The aft end may be configured to receive the propulsive force directly or indirectly from propulsion module 425. The forward end may be configured to transfer or provide the force to electrode 480 to cause deployment of electrode 480 from cartridge 455. In some embodiments, the forward end may be receivable within body 481 of electrode 480 prior to deployment of electrode 480.

The body of piston 420 may define a piston opening 424 on the forward end and extending through to the aft end. Piston opening 424 may comprise varying dimensions from the forward end to the aft end. For example, piston opening 424 proximate the forward end may comprise a greater diameter compared to piston opening 424 proximate the aft end. Piston opening 424 proximate the forward end may also comprise a chamfered edge.

In various embodiments, piston opening 424 may be configured to receive second end 489 of filament 487 from electrode 480. For example, second end 489 of filament 487 may be inserted through piston opening 424 at the forward end of piston 420, and couple proximate to, or aft of, the aft end of piston 420.

In some embodiments, piston opening 424 proximate the aft end of piston 420 may be configured to receive a screw 418. Screw 418 may be configured to couple the second end 489 of filament 487 to piston 424. For example, screw 418 may be inserted within piston opening 424 and filament 487 may be coupled between screw 418 and a surface of piston opening 424. In some embodiments, a surface of piston opening 424 may comprise a rubber surface, or similar material, configured to compress against screw 418 (or the threads of screw 418) in response to screw 418 being coupled to piston opening 424.

In various embodiments, piston 420 may be configured to provide electrical connectivity between body 470 of cartridge 455 and filament 480 of electrode 480. For example, a portion of piston 420 may comprise an electrically conductive material. The electrically conductive material may comprise a portion or all of piston 420. The electrically conductive material may define a channel, passage, or the like through piston 420. The electrically conductive material may be at least partially covered by a non-conductive material to control passage of an electrical signal through the electrically conductive material.

The electrically conductive material may be in contact with inner surface 479 of body 470. For example, before deployment, the electrically conductive material may be in contact at a first location against inner surface 479 of body 470. After deployment, piston 420 may be in contact with piston stop 485. In some embodiments, after deployment the electrically conductive material may be in contact at a first location against inner surface 479 of body 470 and at a second location against piston stop 485. Ensuring electrically contact against two locations of inner surface 479 of body 470 after a deployment may ensure that piston 420 remains in electrical series with body 470 and a CEW handle (e.g., ensure a stimulus signal from the CEW handle can be provided through body 470 and piston 420, and into electrode 480).

The electrically conductive material may be in direct or indirect contact with second end 489 of filament 487. For example, in some embodiments, the electrically conductive material may be in direct contact with second end 489 of filament 487, via piston opening 424. In that regard, an electrical signal may be provided by a CEW handle and through body 470, the electrically conductive material of piston 420, filament 487, and electrode 480. As a further example, in some embodiments, the electrically conductive material may be in indirect contact with second end 489 of filament 487 via screw 418 or a washer of screw 418. In that regard, an electrical signal may be provided by a CEW handle and through body 470, the electrically conductive material of piston 420, screw 418 and/or a washer of screw 418, filament 487, and electrode 480.

In various embodiments, second end 489 of filament 487 may comprise a conductive filament (e.g., non-coated filament wire) to ensure electrical coupling between piston 420, filament 487, and electrode 480. In some embodiments, an entirety of filament 487 may comprise a conductive filament (e.g., non-coated filament wire).

In various embodiments, a portion of piston 420 may comprise an electrically non-conductive material configured to at least partially seal again inner surface 479 of body 470. For example, the electrically non-conductive material be configured to at least partially reduce an amount of the rapidly expanding gas from propulsion module 425 that bypasses piston 420 to exit body 470 with electrode 480. By reducing an amount of the rapidly expanding gas that bypasses piston 420, the force applied again piston 420 and electrode 480 may be increased.

In various embodiments, cartridge 455 may comprise a plug 441 disposed within body 470. Plug 441 may be disposed within body 470 forward of propulsion module 425 and aft of piston 420. Plug 441 may be coupled to, or in contact with, propulsion module 425 at an aft end of plug 441, prior to a deployment. Plug 441 may be coupled to, or in contact with, piston 420 at a forward end of plug 441, prior to a deployment. Plug 441 may comprise any suitable material such as, for example, a material configured to compress and/or aid in the transfer of force. In some embodiments, plug 441 may comprise an electrically non-conductive material, such as a rubber, a plastic, or the like.

In various embodiments, plug 441 may be configured to transfer force between propulsion module 425 and piston 420. For example, the aft end of plug 441 may be configured to receive the propulsive force directly or indirectly from propulsion module 425. The forward end of plug 441 may be configured to transfer or provide the force against piston 420. In response to the force from plug 441, piston 441 may provide a force against electrode 480 to cause deployment of electrode 480 from cartridge 455. Piston 420 may be configured to move in a forward direction (e.g., towards first end 471) responsive to the force from plug 441. As piston 420 moves in the forward direction, piston 420 contacts piston stop 485 causing piston 420 to cease moving forward. Movement of piston 420 may apply a forward force on a rear-end portion of electrode 480 causing electrode 480 to move in the forward direction, exit body 470, and travel toward a target. In various embodiments, as piston 420 travels forward plug 441 may remain coupled to piston 420 (e.g., as piston 420 travels forward, plug 441 similarly travels forward).

In various embodiments, plug 441 may be configured to seal against piston 420. For example, the forward end of plug 441 may be received into piston 420 proximate screw 418. In that regard, the forward end of plug 441 may compress and seal against an aft side of piston 420. A forward end of plug 441 may not contact screw 418 and a gap may exist between plug 441 and screw 418.

In some embodiments, the forward end of plug 441 may contact and seal against screw 418. In that regard, the forward end of plug 441 may compress and seal against an aft side of piston 420 and against screw 418.

In various embodiments, plug 441 may be configured to transfer force to a portion of piston 420. For example, piston 420 may comprise an electrically conductive material (such as a metal) and an electrically non-conductive material (such as a rubber). The electrically conductive material may comprise a more robust and rigid material compared to the non-electrically conductive material. Plug 441 may be configured to contact and compress against the electrically conductive material, and transfer force through the electrically conductive material to cause forward movement of piston 420.

In various embodiments, cartridge 455 may comprise a retaining clip 430 disposed within body 470 at least partially between propulsion module 425 and piston 420. Retaining clip 420 may comprise a body having a first end 432 (e.g., a first retaining end, a forward retaining end, etc.) opposite a second end 433 (e.g., a second retaining end, an aft retaining end, etc.). First end 432 may be coupled to propulsion module 425. Second end 433 may be coupled to piston 420. Retaining clip 420 may enclose (e.g., surround) plug 441. Retaining clip 420 may ensure compression and retention in the cartridge inner assembly between propulsion module 425, plug 441, and piston 420, prior to a deployment from cartridge 455.

In various embodiments, first end 432 may comprise a frangible material configured to break (e.g., release, decouple, etc.) in response to a deployment. For example, first end 432 may comprise one or more mechanical features (e.g., grips, clips, protrusions, etc.) configured to mechanically couple first end 432 to piston 420. In response to piston 420 travelling forward in body 470 (e.g., during a deployment, responsive to a propulsive force from propulsion module 425, etc.), the one or more mechanical features may be configured to break to decouple first end 432 from piston 420. In that regard, piston 420 may travel in a forward direction while retaining clip 430 remains coupled to propulsion module 425.

In other embodiments, first end 432 may be coupled to piston 420 with an adhesive. The adhesive may be configured to unbind responsive to a sufficient force. For example, in response to piston 420 travelling forward in body 470 (e.g., during a deployment, responsive to a propulsive force from propulsion module 425, etc.), the adhesive may unbind to decouple first end 432 from piston 420.

In various embodiments, second end 433 may comprise a frangible material configured to break (e.g., release, decouple, detach, etc.) in response to a deployment. For example, second end 433 may comprise one or more mechanical features (e.g., grips, clips, protrusions, etc.) configured to mechanically couple second end 433 to propulsion module 425. In response to piston 420 travelling forward in body 470 (e.g., during a deployment, responsive to a propulsive force from propulsion module 425, etc.), the one or more mechanical features may be configured to break to decouple second end 433 from propulsion module 425. In that regard, piston 420 may travel in a forward direction together with retaining clip 430 while propulsion module 425 remains stationary (or at least partially stationary).

In other embodiments, second end 433 may be coupled to propulsion module 425 with an adhesive. The adhesive may be configured to unbind responsive to a sufficient force. For example, in response to piston 425 travelling forward in body 470 (e.g., during a deployment, responsive to a propulsive force from propulsion module 425, etc.), the adhesive may unbind to decouple second end 433 from propulsion module 425.

In various embodiments, each of first end 432 and second end 433 may comprise frangible materials configured to respectively break responsive to a force being applied against (e.g., a pushing force, a pulling force, etc.) retaining clip 430.

In various embodiments, cartridge 455 may comprise a wad. The wad may be positioned between two of propulsion module 425, piston 420, and/or plug 441. During launch of electrode 480, the force from the rapidly expanding gas of propulsion module 425 may be applied first against the wad. The wad may apply a force on piston 420, and piston 420 may apply a force on a rear-end portion of electrode 480. The wad may be configured to at least partially reduce an amount of the rapidly expanding gas that bypasses the wad to exit body 470 with electrode 480. The wad may retain the rapidly expanding gas so that the gas does not pass, at least initially, forward of the wad. By retaining the expanding gas, the force applied to the wad, piston 420, and electrode 480 may be increased. Any gas that bypasses the wad may reduce the amount of force that is applied to electrode 480.

In various embodiments, one or more components of the cartridge inner assembly may be replaced after deployment of a projectile from cartridge 455. For example, after deployment of a projectile, propulsion module 425 may be exhausted, retaining clip 430 may be at least partially broken, piston 420 may be displaced, and/or the like. Replacing the components of the cartridge inner assembly may enable body 470 of cartridge 457 to be reused for a second deployment of a second projectile at a later time.

In that regard, one or more components of the cartridge inner assembly may be removable from second end 472. Second end 472 and body 470 may be sized and shaped to enable the removal of the one or more components. For example, in some embodiments contact 457 may couple to and obstruct second end 472. In other embodiments, contact 457 may be part of propulsion module 425 and an aft surface of propulsion module 425 may couple to and obstruct second end 472. Contact 457 and/or propulsion module 425 may be decoupled from second end 472 to remove the one or more components of the cartridge inner assembly from second end 472.

Figure 5A:
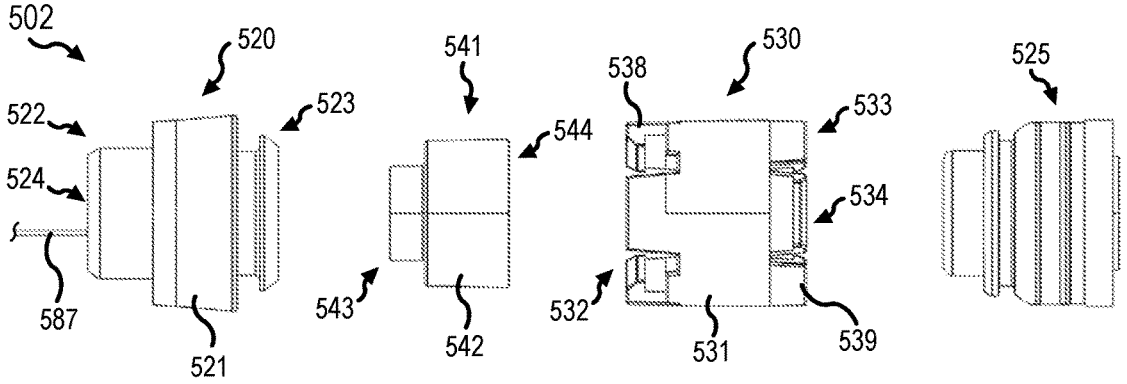
FIGS. 5A-5C are perspective views of a cartridge inner assembly, in accordance with various embodiments.
Figure 5B:
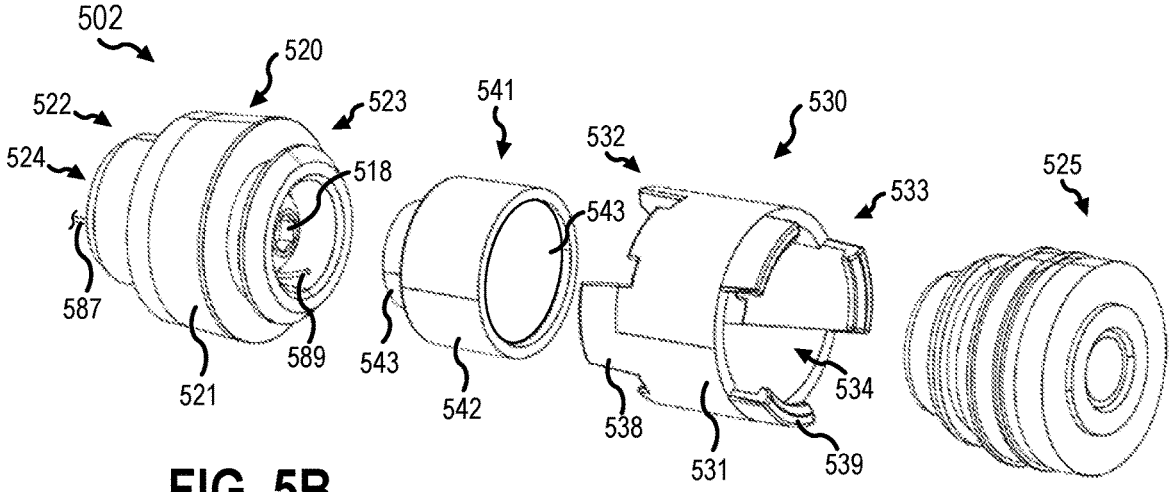
Figure 5C:
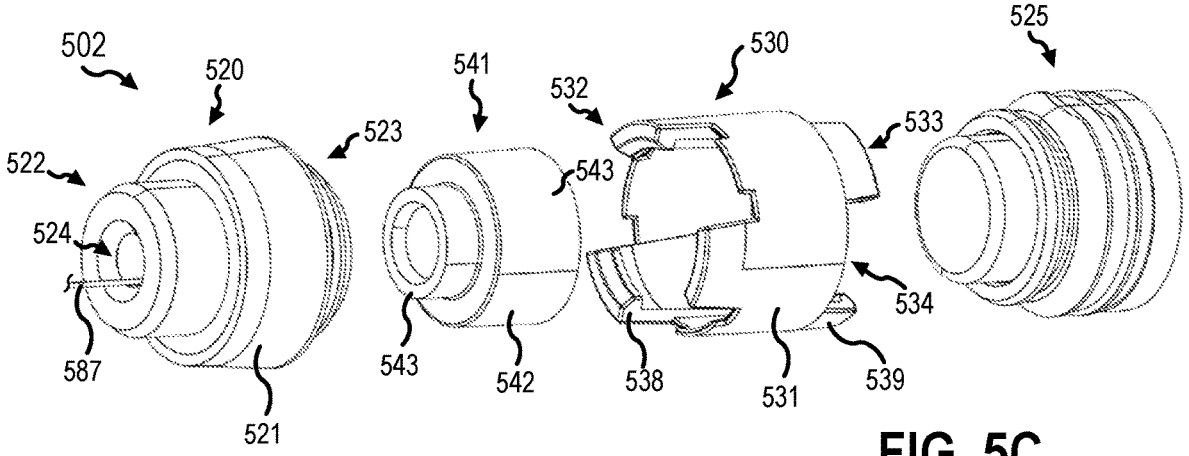

In various embodiments, and with reference to FIGS. 5A-5C, a cartridge inner assembly 502 is disclosed. Cartridge inner assembly 502 may be similar to any other cartridge inner assembly disclosed herein. Cartridge inner assembly 502 may be configured to be disposed within a cartridge. Cartridge inner assembly 502 may be configured to cause deployment of a projectile from the cartridge. Cartridge inner assembly 502 may be configured to at least partially provide a stimulus signal through the projectile (and via a CEW handle). Cartridge inner assembly 502 may comprise one or more of a propulsion module 525, a retaining clip 530, a plug 541, and/or a piston 520.

In various embodiments, propulsion module 525 may be similar to any other propulsion module disclosed herein (e.g., propulsion module 425, with brief reference to FIGS. 4A and 4B). Propulsion module 525 may comprise a propulsion module body having one or more mechanical interfaces. The one or more mechanical interfaces may be configured to engage retaining clip 530, as discussed further herein.

In various embodiments, piston 520 may be similar to any other piston disclosed herein (e.g., piston 420, with brief reference to FIGS. 4A and 4B). Piston 520 may comprise a piston body 521 having a first piston end 522 (e.g., a forward piston end) opposite a second piston end 523 (e.g., an aft piston end). Piston body 521 may comprise varying dimensions from first piston end 522 to second piston end 523. For example, a middle portion of piston body 521 between first piston end 522 and second piston end 523 may comprise a greater diameter than one or more of first piston end 522 and/or second piston end 523. The middle portion of piston body 521 may contact an inner surface of a cartridge body in response to piston 520 being disposed within a cartridge body. The middle portion of piston body 521 meeting at first piston end 522 may define a shelf configured to contact a piston stop within a cartridge body during a deployment of a projectile from the cartridge body (e.g., an outer surface of first piston end 522 may be radially inward from the outer surface of the middle portion of piston body 521).

Piston body 521 may define a piston opening 524 on first piston end 522 and extending through to second piston end 523. Piston opening 524 may comprise varying dimensions from first piston end 522 to second piston end 523. For example, piston opening 524 may be wider at one or more of first piston end 522 and/or second piston end 523 (e.g., a middle portion of piston opening 524 may comprise a smaller diameter than one or more of first piston end 522 and/or second piston end 523). Piston opening 524 at first piston end 522 may be sized and shaped to receive a filament of an electrode, such as, for example, second filament end 589 of filament 587. Piston opening 524 at first piston end 522 may comprise a chamfered edge. In some embodiments, the chamfered edge at first piston end 522 may be configured to reduce strain on filament 587 in response to, or during, a deployment of an electrode.

Piston opening 524 at second piston end 523 may be sized and shaped to receive a screw 518 (and/or a washer for screw 518). Screw 518 may be configured to couple and retain second filament end 589 to piston 520. For example, piston opening 524 may be sized and shaped to enable screw 518 to be recessed within piston opening 524 (e.g., a head of screw 518 does not extend past second piston end 523). Screw 518 may be configured to couple the second end 589 of filament 587 to piston 524. For example, screw 518 may be inserted within piston opening 524 and filament 587 may be coupled between screw 518 and a surface of piston opening 524. In various embodiments, piston opening 524 at second piston end 523 may also be sized and shaped to receive a portion of plug 541, as discussed further herein.

In various embodiments, piston body 521 may comprise one or more mechanical interfaces. The one or more mechanical interfaces may be configured to engage retaining clip 530, as discussed further herein.

In various embodiments, plug 541 may be similar to any other plug, seal, or the like disclosed herein (e.g., plug 441, with brief reference to FIGS. 4A and 4B). Plug 541 may comprise a plug body 542 having a first plug end 543 (e.g., a forward plug end, a piston side end, etc.) opposite a second plug end 544 (e.g., an aft plug end, a propulsion module side end, etc.). Plug 541 may be configured to transfer force from propulsion module 525 to piston 520. Plug 541 may also be configured to at least partially seal against one or more of propulsion module 525 and/or piston 520. Plug 541 may comprise any suitable material such as, for example, a material configured to compress, aid in the transfer of force, fluidly seal, and/or the like. In some embodiments, plug 541 may comprise an electrically non-conductive material, such as a rubber, a plastic, or the like.

Plug body 542 may comprise any suitable shape. For example, in some embodiments plug body 542 may comprise a shape similar to, or complementary with, a cartridge body (e.g., a cartridge body that plug body 542 is configured to be inserted within). As a further example, in some embodiments plug body 542 may be sized and shaped to be received within a retaining clip. As a further example, in some embodiments plug body 542 may comprise a square shape, a cylindrical shape, a triangular shape, and/or any other suitable shape.

First plug end 543 may be configured to contact (e.g., interface, engage, etc.) piston 520. In some embodiments, first plug end 543 may be sized and shaped such that at least a portion of first plug end 543 is insertable within piston 520. For example, first plug end 453 may insert within second piston end 523. First plug end 543 may be adjacent or proximate screw 518. In some embodiments, first plug end 543 may contact screw 518.

In various embodiments, first plug end 543 may comprise a smaller diameter compared to a remainder of plug body 543 (e.g., a forward portion of plug body 543 may comprise a smaller diameter compared to an aft portion of plug body 543). First plug end 543 may comprise a smaller diameter than second plug end 544. The smaller diameter portion may be sized and shaped to contact (e.g., interface, engage, etc.) second piston end 523.

In various embodiments, first plug end 543 may be coupled to second piston end 523, such as, for example, via an adhesive, interference, or the like. In that regard, in response to piston 520 moving forward in a cartridge body during a deployment, plug 541 may remain coupled to piston 520 and may travel forward with piston 520.

Second plug end 544 may be configured to contact (e.g., interface, engage, etc.) propulsion module 525. In some embodiments, second plug end 544 may be sized and shaped such that at least an outer edge of second plug end 544 surrounds a forward end of propulsion module 525. For example, second plug end 544 may comprise a recessed surface defining a circumferential edge that extends axially aft the recessed surface. The recessed surface may be configured to contact the forward end of propulsion module 525 such that the circumferential edge of second plug end 544 at least partially surrounds the forward end of propulsion module 525

In various embodiments, retaining clip 530 may be similar to any other retaining clip disclosed herein (e.g., retaining clip 430, with brief reference to FIGS. 4A and 4B).

Retaining clip 530 may comprise a clip body 531 having a first clip end 532 (e.g., a forward clip end, a piston side clip end, etc.) opposite a second clip end 533 (e.g., an aft clip end, a propulsion module side clip end, etc.). Retaining clip 530 may be configured to retain one or more components of cartridge inner assembly 502 prior to a deployment. Retaining clip 530 may be configured to decouple or disengage from one or more components of cartridge inner assembly 502 responsive to the deployment.

Clip body 531 may comprise any suitable shape. For example, in some embodiments clip body 531 may comprise a shape similar to, or complementary with, a cartridge body (e.g., a cartridge body that clip body 531 is configured to be inserted within). As a further example, in some embodiments clip body 531 may be sized and shaped to receive a plug within clip body 531. As a further example, in some embodiments clip body 531 may comprise a cylindrical shape and/or any other suitable shape.

In various embodiments, clip body 531 may define a retaining clip opening 534 (e.g., a clip body opening, a clip opening, etc.) through clip body 531. Retaining clip opening 534 may begin on first clip end 532 and extend through second clip end 533. Retaining clip opening 534 may be sized and shaped to receive one or more components of cartridge inner assembly 502. Retaining clip opening 534 may be configured to receive plug 541 and at least a portion of piston 520 and/or propulsion module 525. For example, retaining clip opening 534 may be configured to completely enclose plug 451 and at least partially enclose second piston end 523 and a forward end of propulsion module 525.

First clip end 532 may be configured to couple to piston 520. For example, first clip end 532 may be configured to couple to piston 520 proximate second piston end 523. First clip end 532 may couple to piston 520 using any suitable coupling technique, including mechanical, chemical, and/or the like.

In various embodiments, first clip end 532 may comprise one or more mechanical interfaces configured to mechanically couple retaining clip 530 to piston 520. For example, first clip end 532 may comprise one or more piston clips 538. Piston clip 538 may be configured to mechanically engage a surface of piston 520 to couple retaining clip 530 to piston 520. Piston clip 538 may comprise a portion of first clip end 532 extending axially forward first clip end 532. Piston clip 538 may define a grip (or plurality of grips) (e.g., hook, extension, etc.) comprising a portion of piston clip 538 extending radially inward. Piston clip 538 may be configured to engage a shelf, channel, recessed surface, mechanical feature, or the like on piston 520. The shelf, channel, recessed surface, mechanical feature, or the like may comprise a complimentary surface configured to receive and interface with piston clip 538.

Second clip end 533 may be configured to couple to propulsion module 525. For example, second clip end 533 may be configured to couple to propulsion module 525 proximate a forward end of propulsion module 525. Second clip end 533 may couple to propulsion module 525 using any suitable coupling technique, including mechanical, chemical, and/or the like.

In various embodiments, second clip end 533 may comprise one or more mechanical interfaces configured to mechanically couple retaining clip 530 to propulsion module 525. For example, second clip end 533 may comprise one or more propulsion module clips 539. Propulsion module clip 539 may be configured to mechanically engage a surface of propulsion module 525 to couple retaining clip 530 to propulsion module 525. Propulsion module clip 539 may comprise a portion of second clip end 533 extending axially aft second clip end 533. Propulsion module clip 539 may define a grip (or plurality of grips) (e.g., hook, extension, etc.) comprising a portion of propulsion module clip 539 extending radially inward. Propulsion module clip 539 may be configured to engage a shelf, channel, recessed surface, mechanical feature, or the like on propulsion module 525. The shelf, channel, recessed surface, mechanical feature, or the like may comprise a complimentary surface configured to receive and interface with propulsion module clip 539.

In various embodiments, responsive to a deployment piston clip 538 may be configured to decouple from piston 520 while propulsion module clip 539 remains coupled to propulsion module 525. In that respect, piston 520 may travel forward while retaining clip 530 remains stationary and/or coupled to propulsion module 529.

In various embodiments, responsive to a deployment propulsion module clip 539 may be configured to decouple from propulsion module 525 while piston clip 538 remains coupled to piston 520. In that respect, piston 520 may travel forward while retaining clip 530 remains coupled to piston 520 and similarly travels forward.

In various embodiments, piston clip 539 and propulsion module clip 539 may comprise matching (or complimentary) dimensions and features.

In various embodiments, piston clip 539 and propulsion module clip 539 may each comprise one or more different dimensions and/or features. For example, one of piston clip 539 or propulsion module clip 539 may comprise a smaller grip configured to disengage from the respective mechanical coupling prior to the remaining clip. As a further example, one of piston clip 539 or propulsion module clip 539 may comprise a frangible material configured to break during deployment to disengage from its respective mechanical coupling. In some embodiments, piston clip 539 and propulsion module clip 539 may be coplanar. In other embodiments, piston clip 539 and/or propulsion module clip 539 may be circumferentially offset (e.g., piston clip 539 is circumferentially offset from propulsion module clip 539).

In various embodiments, the shelf, channel, recessed surface, mechanical feature, or the like on each of piston 520 and propulsion module 525 may comprise matching dimensions and features.

In various embodiments, the shelf, channel, recessed surface, mechanical feature, or the like on each of piston 520 and propulsion module 525 may each respective comprise different dimensions and/or features. For example, the shelf, channel, recessed surface, mechanical feature, or the like on piston 520 may be shallower or contain smaller dimensions compared to the shelf, channel, recessed surface, mechanical feature, or the like on propulsion module 525. As a further example, the shelf, channel, recessed surface, mechanical feature, or the like on propulsion module 525 may be shallower or contain smaller dimensions compared to the shelf, channel, recessed surface, mechanical feature, or the like on piston 520. A shallower or smaller dimensioned shelf, channel, recessed surface, mechanical feature, or the like may cause the respective clip to disengage during a deployment while the remaining opposite clip remains engaged.

In other embodiments, the shelf, channel, recessed surface, mechanical feature, or the like of a respective piston 520 or propulsion module 525 may comprise a less rigid material and/or a surface coating to cause the respective clip to decouple during a deployment.

Figure 6A:
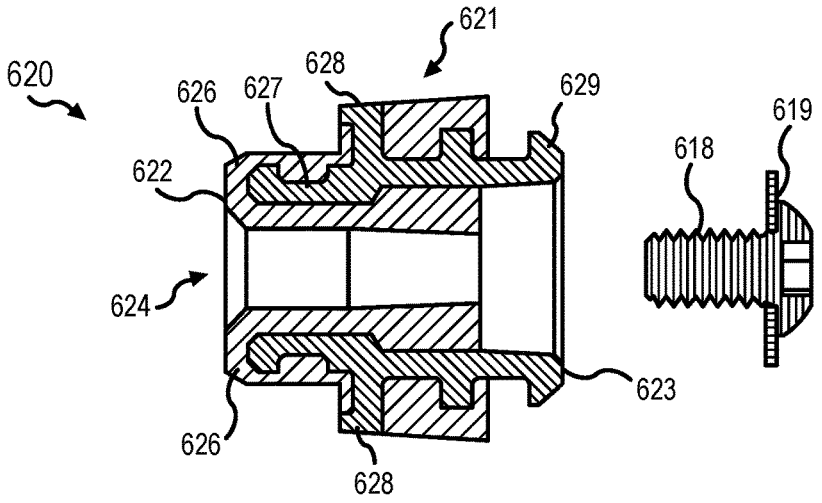
FIGS. 6A-6C are cross-sectional and perspective views of a piston, in accordance with various embodiments.
Figure 6B:
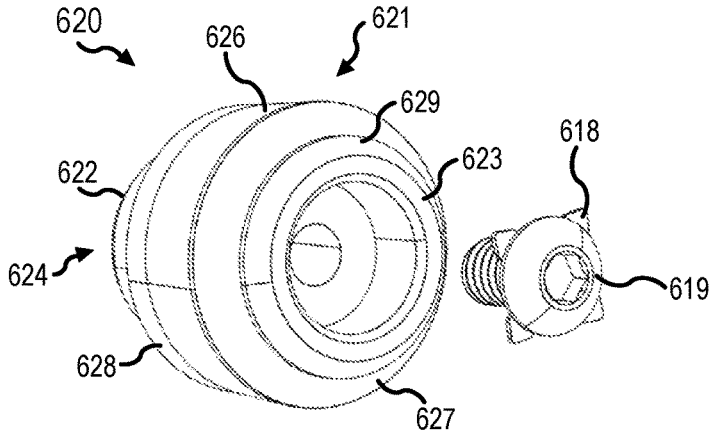
Figure 6C:
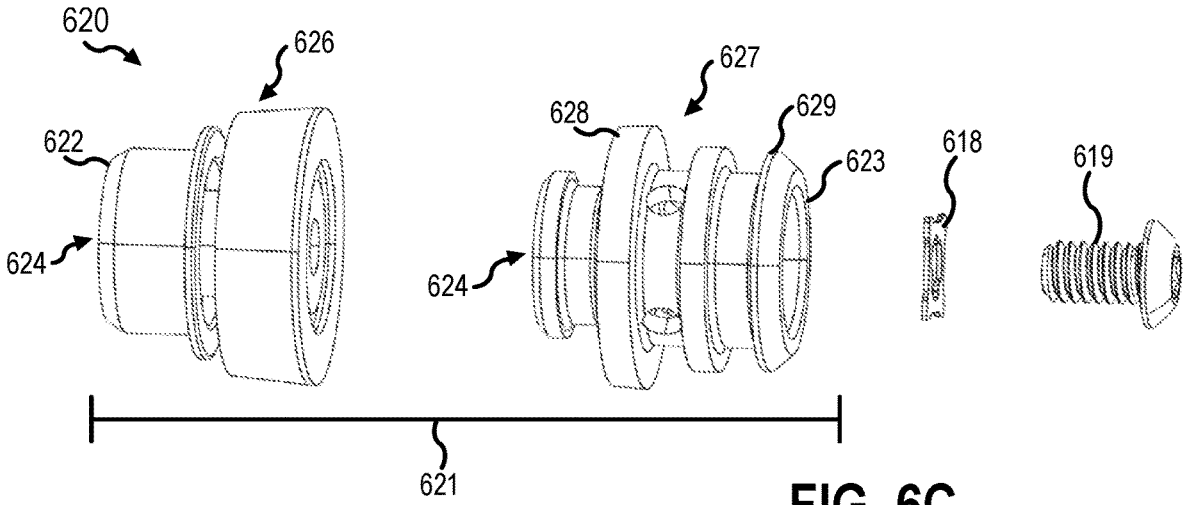

In various embodiments, and with reference to FIGS. 6A-6C, a piston 620 is disclosed. Piston 620 may be similar to any other piston disclosed herein (e.g., piston 420, with brief reference to FIGS. 4A and 4B; piston 520, with brief reference to FIGS. 5A-5C; etc.). Piston 620 may comprise a piston body 621 having a first piston end 622 (e.g., a forward piston end) opposite a second piston end 623 (e.g., an aft piston end).

Piston body 621 may define a piston opening 624 beginning at first piston end 622 and extend through to second piston end 623.

Piston opening 624 may comprise varying dimensions from first piston end 622 to second piston end 623. For example, piston opening 624 may be wider at one or more of first piston end 622 and/or second piston end 623 (e.g., a middle portion of piston opening 624 may comprise a smaller diameter than one or more of first piston end 622 and/or second piston end 623). A middle portion of piston opening 624 between first piston end 622 and second piston end 623 may comprise varying dimensions. For example, a first middle portion proximate first piston end 622 may be wider than a second middle portion proximate second piston end 623. Piston opening 624 at first piston end 622 may be sized and shaped to receive a filament of an electrode. Piston opening 624 at first piston end 622 may comprise a chamfered edge. In some embodiments, the chamfered edge at first piston end 622 may be configured to reduce strain on a filament in response to, or during, a deployment of an electrode.

Piston opening 624 at second piston end 623 may be sized and shaped to receive a screw 618 and/or a washer 619. Screw 618 and/or washer 619 may be configured to couple and retain a second filament end to piston 620. For example, piston opening 624 at second piston end 623 may be sized and shaped to enable screw 618 and/or washer 619 to be recessed within piston opening 624 (e.g., a head of screw 618 does not extend past second piston end 623, a body of washer 619 does not extend past second piston end 623, etc.).

Screw 618 and/or washer 619 may be configured to couple the second end of a filament to piston 620. For example, screw 618 may be inserted within piston opening 624 and the filament may be coupled between screw 618 and a surface of piston opening 624. In some embodiments, a middle portion of piston opening 624 proximate second piston end 623 (e.g., the second middle portion) may be sized and shaped to couple screw 618 to piston opening 624. In various embodiments, piston opening 624 at second piston end 623 may also be sized and shaped to receive a portion of a plug, as discussed further herein.

Piston body 621 may comprise varying dimensions from first piston end 622 to second piston end 623. For example, a middle portion of piston body 621 between first piston end 622 and second piston end 623 may comprise a greater diameter than one or both of first piston end 622 and/or second piston end 623. The middle portion of piston body 621 may contact an inner surface of a cartridge body in response to piston 620 being disposed within a cartridge body. The middle portion of piston body 621 meeting at first piston end 622 may define a shelf configured to contact a piston stop within a cartridge body during a deployment of a projectile from the cartridge body (e.g., an outer surface of first piston end 622 may be radially inward from the outer surface of the middle portion of piston body 621).

In various embodiments, piston body 621 may comprise a plurality of structures having different materials and dimensions. For example, piston body 621 may comprise a piston body overmold 626 and a piston conductive body 627. Piston body overmold 626 and piston conductive body 627 may be coupled together using any suitable technique. In some embodiments, piston body overmold 626 may be formed over (and within) piston conductive body 627 using an injection molding process. Piston body overmold 626 may comprise an electrically non-conductive material, such as, for example, a rubber, a plastic, and/or the like. Piston conductive body 627 may comprise an electrically conductive material, such as, for example, a metal, and/or the like. In some embodiments, piston conductive body 627 may comprise a more rigid material compared to piston body overmold 626.

In various embodiments, piston body overmold 626 may be configured to at least partially surround (e.g., cover, obstruct, etc.) piston conductive body 627. For example, piston body overmold 626 may be configured to at least partially cover an outer surface of piston conductive body 627. Piston body overmold 626 may be configured to at least partially cover an inner surface of piston conductive body 627. For example, piston body overmold 626 may at least partially define piston opening 624 (e.g., screw 618 may be configured to couple to piston body overmold 626). Piston body overmold 626 may be configured to completely cover piston conductive body 627 at first piston end 622. Piston body overmold 626 may be configured to expose (e.g., no cover) piston conductive body 627 at second piston end 623.

In various embodiments, piston body overmold 626 may be configured to selectively expose one or more portions of piston conductive body 627. For example, piston body overmold 626 may be configured to selectively expose an exposed surface 628 of piston conductive body 627. Exposed surface 628 may comprise a portion, such as a middle portion, of piston conductive body 627 that extends radially outward from piston conductive body 627. Exposed surface 628 may be configured to contact an inner surface of a cartridge body to electrically couple piston 620 to the cartridge body. Piston conductive body 627 may be electrically coupled to screw 618 and/or washer 619. For example, in some embodiments, washer 619 may contact an inner surface of piston conductive body 627 to electrically couple washer 619 and screw 618 to piston conductive body. A second end of a filament may be coupled to screw 618 and/or washer 618 such that the filament may be in electrical series with the cartridge body via piston conductive body 627. As a further example, in some embodiments, washer 619 may not contact the inner surface of piston conductive body 627, but may position the second end of the filament such that the second end of the filament contacts the inner surface of piston conductive body 627. In that regard, an electrical signal may be provided though the cartridge body, exposed surface 628, screw 618 and/or washer 619, the second end of the filament coupled to screw 618, and to the electrode coupled to the filament.

In some embodiments, exposed surface 628 may include an outer exposed surface (e.g., a first exposed surface, a radially outward surface, etc.) and a forward exposed surface (e.g., a second exposed surface, an axially forward surface, etc.). The outer exposed surface may be configured to contact the inner surface of a cartridge body before, during, and after a deployment. The forward exposed surface may be configured contact a piston stop defined on the inner surface of the cartridge body. In that respect, the forward exposed surface may contact the piston stop in response to piston 620 contacting the piston stop during a deployment (e.g., the forward exposed surface may contact the piston stop during and/or after a deployment).

In that regard, before, during, and after a deployment, an electrical signal may be provided though the cartridge body, the outer exposed surface of exposed surface 628, screw 618 and/or washer 619, the second end of the filament coupled to screw 618, and to the electrode coupled to the filament. During and/or after the deployment, the electrical signal may further be provided through the cartridge body, the forward exposed surface of exposed surface 628, screw 618 and/or washer 619, the second end of the filament coupled to screw 618, and to the electrode coupled to the filament. Ensuring two contact points for electrical connectivity during and/or after a deployment may at least partially ensure the cartridge body provides the electrical signal to the electrode throughout the deployment (e.g., before, during, and/or after).

As a further example, piston body overmold 626 may be configured to selectively expose a coupling point 629 (e.g., an aft coupling point) of piston conductive body 627. Coupling point 629 may comprise a portion of piston conductive body 627 extending axially aft piston conductive body 627. Coupling point 629 may comprise one or more mechanical features configured to couple to a retaining clip, as previously discussed herein. Coupling point 629 may also be configured to provide a contact surface for a plug. For example, the plug may be inserted within the retaining clip. The retaining clip may couple to coupling point 629 as the plug contacts against coupling point 629. Ensuring contact between the plug and contact point 629 may allow the plug to transfer force during a deployment to a rigid surface of piston 620 (e.g., piston conductive body 627).

Figure 7A:
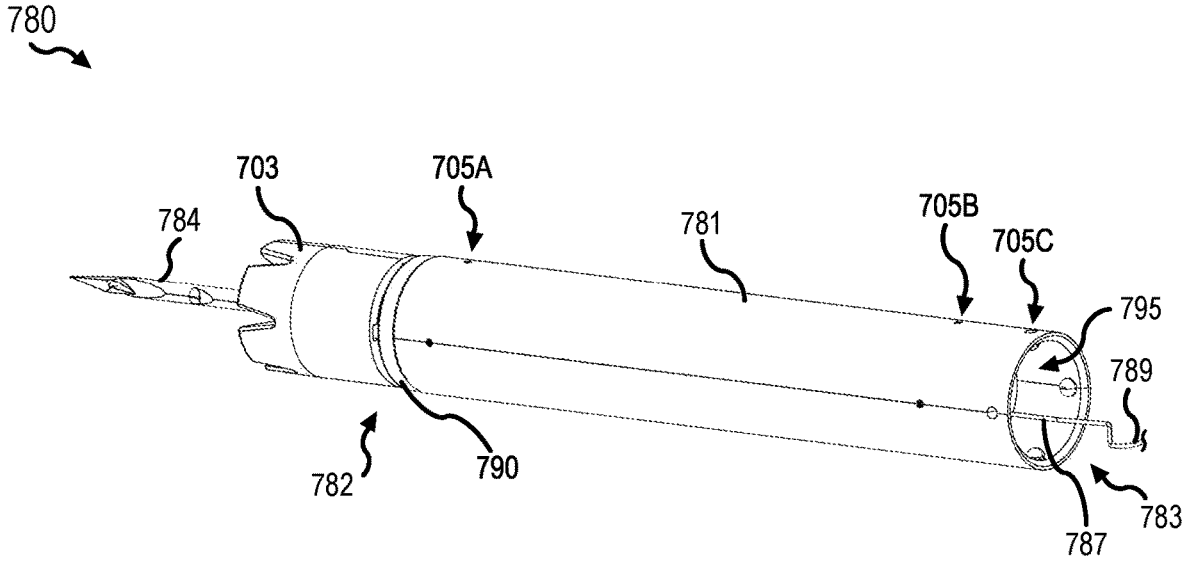
FIGS. 7A-7C are perspective and cross-sectional views of an electrode, in accordance with various embodiments.
Figure 7B:
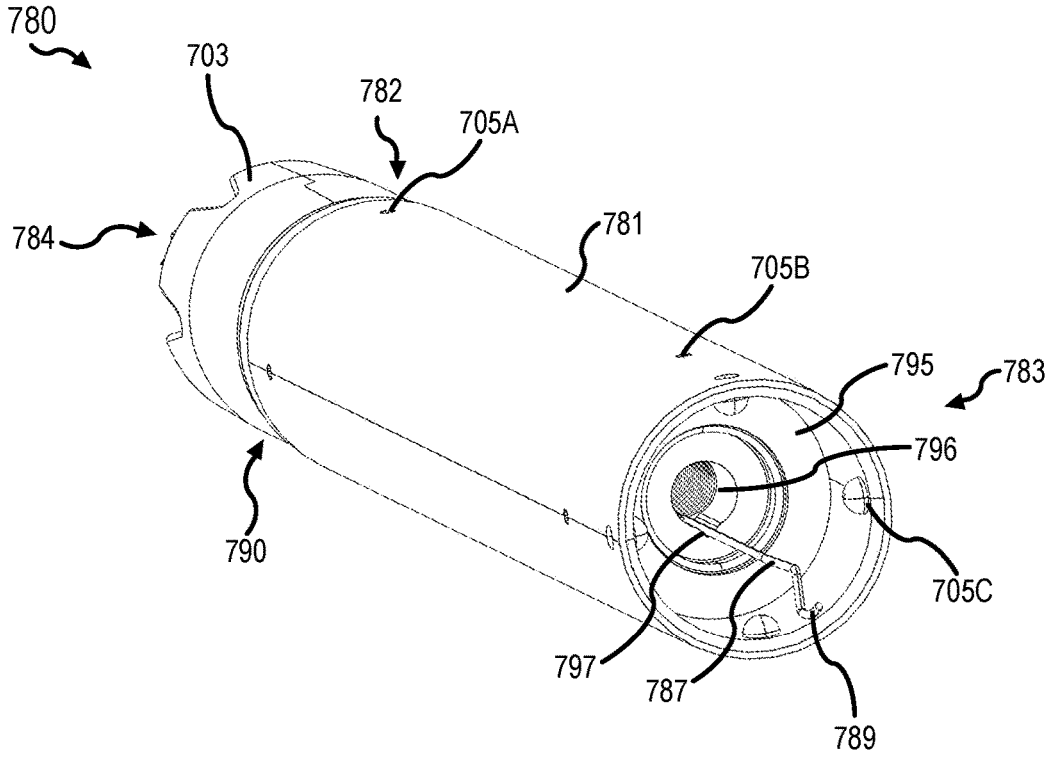
Figure 7C:
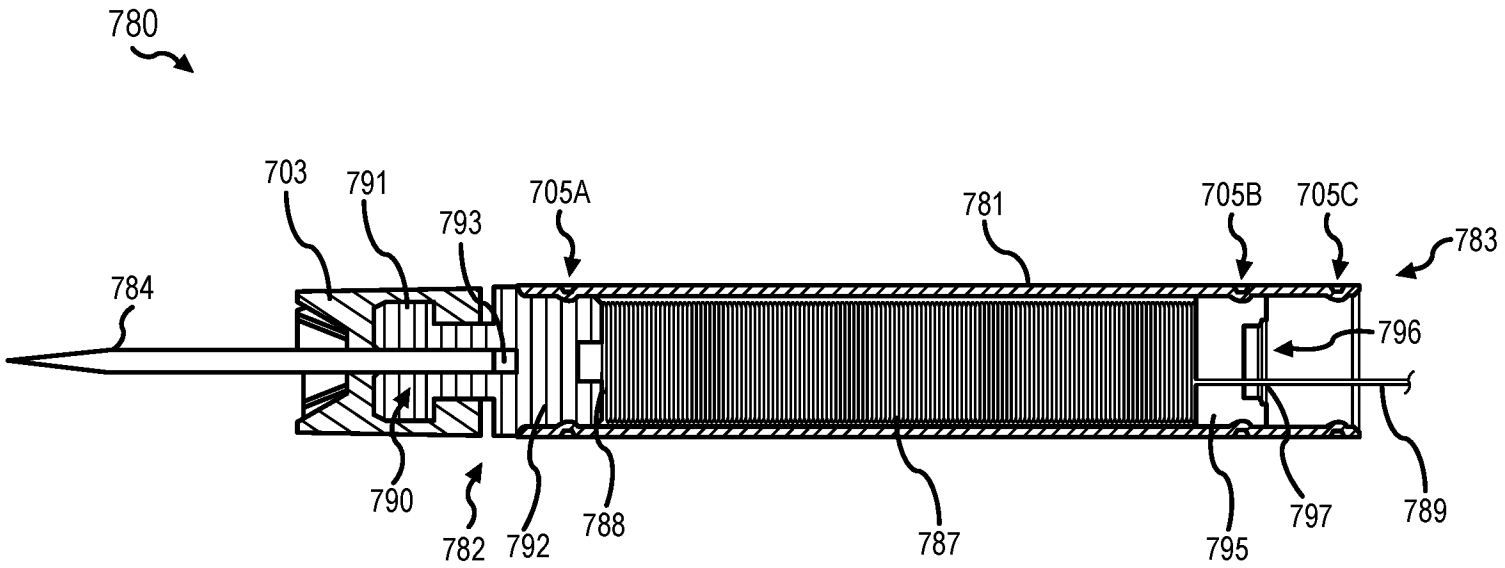

In various embodiments, and with reference to FIGS. 7A-7C, an electrode 780 is disclosed. Electrode 780 may be similar to any other electrode, projectile, or the like. Electrode 780 may be used in conjunction with any cartridge disclosed herein. Electrode 780 may comprise an electrode body 781 having a first end 782 (e.g., a first electrode end, a forward end, etc.) opposite a second end 783 (e.g., a second electrode end, an aft end, a rearward end, etc.). Electrode body 781 may comprise an outer surface opposite an inner surface. Electrode body 781 may define a cylindrical body. In some embodiments, a shape of electrode body 781 may be complimentary to a cartridge configured to receive electrode 780 (e.g., electrode body 781 may be complimentary with one or more inner surfaces of a cartridge).

In various embodiments, electrode 780 may comprise a head 790 (e.g., front head, electrode head, interchangeable head, etc.). Head 790 may comprise a first head end 791 opposite a second head end 792.

Second head end 792 may be coupled to electrode body 781 (e.g., at first end 782). Second head end 792 may be coupled to electrode body 781 such that a portion of head 790 is received within electrode body 781. The portion of head 790 received within electrode body 781 may be less than half of head 790. In some embodiments, the portion of head 790 received within electrode body 781 may be 30% of head 790. In some embodiments, the portion of head 790 received within electrode body 781 may be less than 40% of head 790; less than 40%, 30%, or 20% of head 790; about 40%, 30%, or 20% of head 790; and/or any other similar portion of head 790 (wherein "about" as used in this context refers only to +/−5%). In some embodiments, the portion of head 790 received within electrode body 781 may be greater than half of head 790.

Head 790 may be configured to receive one or more attachments (e.g., head attachments, accessories, etc.). Head 790 may be configured to receive a single attachment. Head 790 may be configured to receive a plurality of attachments. An attachment may be configured to couple to a front surface (e.g., a radially forward surface) of first head end 791. An attachment may be configured to couple to an axially outer surface of first head end 791. An attachment may be configured to couple to head 790 at a middle portion between first head end 791 and second head end 792. In some embodiments, an attachment may be configured to couple to head 790 at one or more of a front surface, an axially outer surface, and/or a middle portion of head 790.

First head end 791 may be configured to receive a first attachment configured to enable electrode 780 to couple to a target. For example, the first attachment may comprise a spear (e.g., spear 784), a hook, a barb, a training attachment, a hook and loop attachment, and/or the like. In some embodiments, the first attachment may comprise an electrically conductive material.

First head end 791 may be configured to receive a second attachment configured to provide a property to electrode 780. The property may comprise a physical property, a physical characteristic, and/or the like. For example, the property may comprise an aerodynamic property. In that regard, the second attachment may be coupled to head 790 and configured to change an aerodynamic property or characteristic of electrode 780 (e.g., lift, drag, etc.). As a further example, the property may comprise a force absorbing property. In that regard, the second attachment may be coupled to head 790 and configured to at least partially reduce an impact force of electrode 780 against a target. The second attachment may at least partially absorb a force of impact with a target thereby reducing potential tissue or skin damage (e.g., bruising, tearing, etc.) to the target. The second attachment may reduce a momentum of electrode 780 after impact with a target, thereby hindering (e.g., preventing) electrode 780 from bouncing off of (e.g., deflecting) the target with enough residual force to decouple electrode 780 from a surface (e.g., clothing, tissue, etc.) of the target. The second attachment may comprise a pad, a shock absorber, a thermoplastic elastomer, a rubber, and/or the like. In various embodiments, the second attachment may comprise an electrically non-conductive material.

In various embodiments, a first attachment and a second attachment may couple to head 790 at first head end 791. In some embodiments, a second attachment may couple to each of head 790 and the first attachment. In various embodiments, head 790 may comprise a first mechanical feature configure to receive the first attachment and a second mechanical feature configured to receive the second attachment. The first mechanical feature may comprise an opening, channel, groove, protrusion, or the like. The second mechanical feature may comprise a shape of head 790.

In various embodiments, first head end 791 may be sized and shaped to receive one or more attachments. For example, first head end 791 may comprise a channel 793 (e.g., head channel, attachment channel, etc.) configured to allow an attachment to couple to head 790. Channel 793 may define an opening on first head end 791 extending into a body of head 790. Channel 793 may not extend through to second head end 792. Channel 793 may be configured to receive a first attachment.

In some embodiments, electrode 791 may comprise a spear 784 coupled within channel 793. For example, spear 784 may be coupled within channel 793 mechanically or chemically. A mechanical coupling may comprise an interference fit, a press fit, a deformation, or the like. A chemical coupling may include an adhesive, and/or the like. Spear 784 may be coupled within channel 793 such that a gap exists between an end of spear 784 and an inner end of channel 793. In other embodiments, an end of spear 784 may abut against (e.g., contact) an inner end of channel 793.

First head end 791 may comprise a shape configured to receive an attachment. For example, head 790 at first head end 791 may comprise a "T-shape" wherein an outer portion of first head end 791 (e.g., a first portion) comprises a greater diameter than an inner portion of head end 791 (e.g., a second portion). The T-shape may be configured to receive a second attachment. The outer portion and the inner portion of first head end 791 may further at least partially define channel 793. The outer portion of first head end 791 may be axially forward the inner portion of first head end 791.

In various embodiments, electrode 780 may comprise an absorber 703 (e.g., a shock absorber, an impact absorber, a bumper, etc.). Absorber 703 may be coupled to head 790. Absorber 703 may be coupled to head 790 using a mechanical coupling, a chemical coupling, and/or the like. Absorber 703 may be coupled to first head end 791. Absorber 703 may be coupled to head 790 forward second head end 792. Absorber 703 may be coupled to a T-shape defining first head end 791. Absorber 703 may comprise an outer surface radially outward an outer surface of head 790. Absorber 703 may comprise an aft inner surface that is radially inward from first head end 791 and second head end 792, but radially outward from a middle portion of head 790. The aft inner surface may be axially aft first head end 791 and axially forward second head end 792. In some embodiments, absorber 703 may be molded over head 790 such as, for example, using an injection molding process.

Absorber 703 may extend forward head 790. In some embodiments, absorber 703 may define an opening configured to receive spear 784. In some embodiments, absorber 703 may be coupled to spear 784.

Absorber 703 may be configured to at least partially absorb (or receive) a force of impact with a target thereby reducing potential tissue or skin damage (e.g., bruising, tearing, etc.) to the target. Absorber 703 may reduce a momentum of electrode 780 after impact with a target, thereby hindering (e.g., preventing) electrode 780 from bouncing off of (e.g., deflecting) the target with enough residual force to decouple electrode 780 from a surface (e.g., clothing, tissue, etc.) of the target. Absorber 703 may comprise a pad, a shock absorber, a thermoplastic elastomer, a rubber, and/or the like. In various embodiments, Absorber 703 may comprise an electrically non-conductive material. Spear 784 may comprise an electrically conductive material configured to provide a stimulus signal to the target.

In various embodiments, one or more portions of absorber 703 may be formed of a deformable (e.g., flexible, etc.) material. Upon impact with a target, the deformable material may be configured to elastically (e.g., temporarily, etc.) deform, or plastically (e.g., permanently, etc.) deform. The deformable material may include thermoplastic vulcanizates (e.g., SANTOPRENE), silicone rubbers, polyurethanes, polybutadienes, and other materials configured to deform upon impact with a target. The deformable material may include resilient materials (e.g., materials having high yield strengths and low moduli of elasticity, materials exhibiting spring-like properties, etc.). The deformable material may include elastomeric materials. The deformable material may include soft materials.

In various embodiments, absorber 703 may comprise one or more features, structures, or the like configured to at least partially aid in absorber 703 absorbing (or receiving) a force of impact with a target. Absorber 703 may be configured to reduce an impact force provided by an impact (e.g., collision) of electrode 780 and the target. A front absorber end of absorber 703 may be configured to minimize blunt impact and/or penetration of the forward portion of electrode 780 with the target by distributing the impact force (e.g., force of impact, etc.) of electrode 780 over a greater impact area (e.g., area of impact, contact area, surface contact area, etc.), distributing the impact force of electrode 780 over a longer duration (e.g., increasing a duration of impact, etc.), and/or absorbing kinetic energy of electrode 780. The front absorber end may comprise an expandable portion. After a length of spear 784 penetrates a target, the expandable portion of the front absorber end may impact the target and expand (e.g., change shape, deform, etc.) to increase a contact area of electrode 780 with the target. Expansion of the expandable portion of the front absorber end may absorb kinetic energy of an impact of electrode 780 with a target. In other embodiments, deployment of electrode 780 may cause the expandable portion of the front absorber end to expand to increase the contact area of electrode 780 with the target prior to impact. An increase in contact area of electrode 780 with a target may reduce an impact pressure exerted by electrode 780 on the target. The front absorber end of absorber 703 may reduce a likelihood of blunt impact and/or penetration of a body of electrode 780 with a target, thereby enabling electrode 780 to be launched from a CEW and impact a target with greater kinetic energy than an electrode without an absorber. For example, electrode 780 comprising absorber 703 may impact a target with 12 joules of energy without risk of the forward portion of electrode 780 penetrating the target, whereas an electrode without an absorber may only impact a target with 6 joules of energy without risk of the forward portion of the electrode penetrating the target.

In various embodiments, the front absorber end absorber 703 may define an expandable portion. For example, the expandable portion may be configured to expand upon impact with a target to increase a contact area between absorber 703 and the target and/or absorb a portion of the impact force imparted on the target by electrode 780. Prior to impact and/or launch of electrode 780, the expandable portion may be in a collapsed state. After (or during) impact and/or launch of electrode 780, the expandable portion may be forced into an expanded state. The expandable portion may comprise one or more members (e.g., fingers). For example, the expandable portion may include members extending in an axially forward direction from the front absorber end of absorber 703. The members may be arranged at regularly spaced circumferential intervals, such as every 30 degrees, every 60 degrees, every 90 degrees, and/or the like. Each member may be separated from adjacent members by a channel (e.g., slot, void, etc.). A shape of a channel may comprise a V-shape, a U-shape, a C-shape, a square shape, and/or any other suitable or desired shape. For example, the front absorber end may comprise a plurality of channels, wherein each member of a plurality of members is separated from an adjacent member of the plurality of members by a respective channel of the plurality of channels. At least one channel of a plurality of channels may be disposed between pair of adjacent members of a plurality of members of the expandable portion. In various embodiments, the arrangement and shape of the members in combination with the arrangement and shape of the channels may generally comprise a castellated nut (i.e., castle nut, etc.) shape or a slotted inverted (e.g., reversed) frustoconical cup shape.

In response to impact and/or launch of electrode 780, the members of the expandable portion may flex (e.g., deform) radially outward. For example, as absorber 703 impacts a target, the force of the impact may cause each member to deform outward, thereby further increasing the impact area of absorber 703 over the duration of impact. For example, as electrode 780 flies toward a target, momentum of electrode 780 causes spear 784 to pierce the target. Typically, however, the momentum of electrode 780 is not exhausted by penetration of spear 784. The remaining momentum of electrode 780 is transferred to the target via impact of absorber 703 with the target. Absorber 703 is configured to reduce the impact force in response to the change in momentum, thereby preventing further penetration of at least a portion of electrode 780 (e.g., forward portion, electrode body, etc.) into the target. The expandable portion of the front absorber end of absorber 703 may expand (e.g., deform), thereby extending the impact time of absorber 703 with the target, which in turn reduces the impact force. As the expandable portion expands, the impact area may increase (e.g., by members flaring radially outward), thereby distributing the force of impact over a greater area, which in turn may prevent electrode body 781 from penetrating or further impacting the target. Increasing the impact area while also extending the impact time may have a synergistic effect on reducing blunt impact and preventing penetration of tissue of a target by electrode body 781.

In various embodiments, head 790 may comprise varying dimensions from first head end 791 to second head end 792. For example, head 790 may comprise an hourglass shape wherein first head end 791 and second head end 792 each comprise a greater diameter than a middle portion of head 790 between first head end 791 and second head end 792. First head end 791 may comprise a first diameter, second head end 792 may comprise a second diameter, and a middle portion of head 790 may comprise a third diameter (each diameter may also be referred to as a head diameter). The first diameter and the second diameter may each be greater than the third diameter (e.g., a middle portion diameter). The first diameter may be less than the second diameter. The second diameter may be greater than the first diameter and the third diameter.

As discussed further herein, head 790 may be configured to receive an attachment. The attachment may be coupled to the middle portion of the head. The attachment may comprise varying thicknesses. For example, the attachment may comprise a first thickness proximate a portion of the attachment contacting first head end 791. The attachment may comprise a second thickness proximate a portion of the attachment contacting the middle portion. The first thickness and the first diameter may be substantially similar in size to the second thickness and the middle portion diameter. The first thickness and the first diameter may be less than or substantially similar in size to the second diameter. The second thickness and the middle portion diameter may be less than or substantially similar in size to the second diameter.

In various embodiments, head 790 may comprise an electrically conductive material. For example, head 790 may comprise a metal material. Head 790 may comprise a metal alloy such as, for example, brass.

In various embodiments, electrode 780 may comprise a filament 787 (e.g., a wire-tether, a wire, etc.). Filament 787 may comprise an electrically conductive material configured to electrically couple electrode 780 to a cartridge, a magazine, and/or a CEW handle. In that regard, filament 787 may be configured to provide a stimulus signal and/or an ignition signal to electrode 780 via a signal generator of a CEW handle.

Filament 787 may comprise a first filament end 788 opposite a second filament end 789. First filament end 788 may be coupled to electrode 780. In some embodiments, first filament end 788 may be coupled to head 790. For example, first filament end 788 may be welded to head 790. As a further example, first filament end 788 may be coupled between head 790 and an inner surface of electrode body 781. For example, first filament end 788 may be inserted between head 790 and electrode body 781, and electrode body 781 may be press-fit (e.g., deformed) to couple electrode body 781 to head 790. The press-fit between electrode body 781 and head 790 may couple first filament end 788 between electrode body 781 and head 790.

Second filament end 789 may extend aft electrode 780 and may be configured to couple within a cartridge. For example, and as discussed previously herein, second filament end 789 may be coupled to a piston within a cartridge. In that regard, head 790, filament 788, and a cartridge may be in electrical series.

In various embodiments, filament 788 may be electrically conductive from first filament end 788 to second filament end 789. For example, filament 788 may be non-insulated from first filament end 788 to second filament end 789.

In various embodiments, filament 788 may be comprise an insulated outer layer. First filament end 788 may be non-insulated at a location coupling first filament end 788 to head 790. Second filament end 789 may be non-insulated at a location coupling second filament end 789 to a cartridge (e.g., a piston of a cartridge, as previously discussed herein).

In various embodiments, filament 788 may be stored in electrode body 781. For example, filament 788 may be wound in a winding (e.g., coils, filament winding, etc.). The winding may be stored within electrode body 781. During a deployment, electrode 780 may travel in a direction forward a cartridge. During travel, filament 788 may unravel (e.g., uncoil, unwind, etc.) from the winding to deploy filament 788 aft electrode 781.

In various embodiments, electrode 780 may comprise a rear nozzle 795. Rear nozzle 795 may be disposed within electrode body 781. Rear nozzle 795 may be disposed within electrode body 791 proximate second end 783. Rear nozzle 795 may be disposed within electrode body 791 forward second end 783. For example, second end 783 may be configured to receive a portion of a piston in response to electrode 780 being disposed within a cartridge (e.g., as depicted in FIG. 4B). In various embodiments, rear nozzle 795 may be disposed forward second end 783 such that rear nozzle 795 may not contact the piston (e.g., before a deployment of electrode 780 from the cartridge). In various embodiments, rear nozzle 795 may be disposed forward second end 783 such that rear nozzle 795 abuts the piston while electrode 780 is stored within the cartridge. In that regard, rear nozzle 795 may provide a contact surface configured to receive a force from the piston during a deployment. In some embodiments, rear nozzle 795 may be axially offset second end 783.

Rear nozzle 795 may define an opening 796. Opening 796 may be radially centered within electrode body 781. Rear nozzle 795 may be configured to position filament 787 as filament 787 unwinds and exits electrode 780. For example, as filament 787 deploys from electrode 780, filament 787 moves through opening 796. Friction between an inner wall of opening 796 and filament 787 applies a force on filament 787. Applying a force on filament 787 during a deployment provides drag on electrode 780. Providing drag on electrode 780 increases stability of flight and accuracy of flight of electrode 780 along an intended trajectory. Increasing stability of flight and/or accuracy of flight may improve the repeatability of flight along intended trajectory of electrodes launched from different cartridges.

In various embodiments, opening 796 may further define a groove 797. Groove 797 may comprise an axial groove in opening 796 extending radially inward from opening 796 towards an inner surface of cartridge body 781. Groove 797 may be sized and shaped to receive filament 787.

In various embodiments, groove 797 may position filament 787 prior to a deployment. During the deployment, filament 787 may unwind and may leave groove 797 (e.g., to contact opening 796). In various embodiments, groove 797 may position filament 787 prior to and during a deployment. For example, during the deployment filament 787 may remain within groove 797.

In various embodiments, electrode 780 may be part of a cartridge inner assembly. For example, electrode 780 may be coupled to a cartridge inner assembly and may be inserted together with a cartridge inner assembly into a second end of a cartridge body. Electrode 780 may be coupled to a piston from the cartridge inner assembly.

In various embodiments, electrode 780 (e.g., electrode body 781) may comprise one or more coupling points. Each coupling point may comprise a mechanical coupling, a chemical coupling, and/or the like. For example, electrode 780 may comprise a first coupling point 705A, a second coupling point 705B, and a third coupling point 705C.

First coupling point 705A may be located proximate first end 782 of electrode body 781. First coupling point 705A may comprise a coupling of electrode body 781 to head 790. For example, first coupling point 705A may comprise a deformation (e.g., inward protrusion, press fit, staking, etc.) of electrode body 781 to couple head 790 within electrode body 781.

Second coupling point 705B may be located forward second end 783 of electrode body 781. Second coupling point 705B may be between first coupling point 705A and third coupling point 705C. Second coupling point 705B may comprise a coupling of electrode body 781 to rear nozzle 795. For example, second coupling point 705B may comprise a deformation (e.g., inward protrusion, press fit, staking, etc.) of electrode body 781 to couple rear nozzle 795 within electrode body 781.

Third coupling point 705C may be located proximate second end 783 of electrode body 781. Third coupling point 705C may be aft second coupling point 705B. Third coupling point 705C may comprise a coupling of electrode body 781 to a piston. For example, as previously discussed with reference to FIGS. 4A and 4B, electrode body 781 may be coupled to a piston prior to a deployment. Third coupling point 705C may comprise a deformation (e.g., inward protrusion, press fit, staking, etc.) of electrode body 781 to couple a piston within electrode body 781. Third coupling point 705C may be configured to decouple during a deployment. For example, third coupling point 705C may decouple responsive to a sufficient force (e.g., in response to a piston contacting a piston stop within the cartridge).

In various embodiments, first coupling point 705A and second coupling point 705B may remain coupled before, during, and after a deployment. Third coupling point 705C may remain coupled before the deployment, but decouple during the deployment.

In various embodiments, first coupling point 705A may decouple after a deployment. For example, before and during a deployment first coupling point 705A may remain coupled. In response to electrode 780 contacting a target after the deployment, a force of impact may cause first coupling point 705A to decouple to allow electrode body 781 to decouple from head 790. In that respect, head 790 may remain coupled to the target as electrode body 781 decouples and falls away from the target. Second coupling point 705B may remain coupled before, during, and after the deployment. Third coupling point 705C may remain coupled before the deployment, but decouple during the deployment.

Figure 8A:
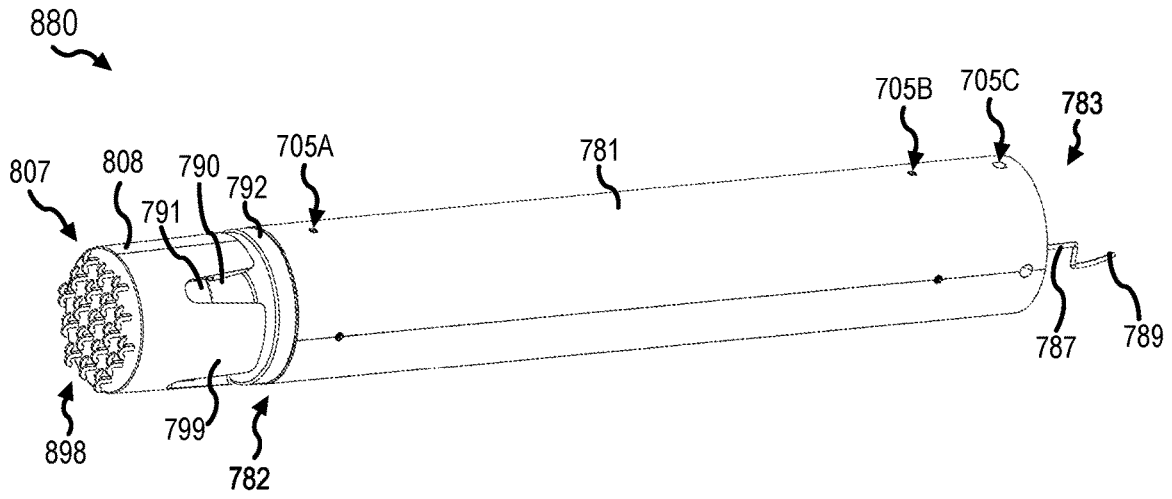
FIGS. 8A and 8B are perspective and cross-sectional views of a training electrode, in accordance with various embodiments.
Figure 8B:
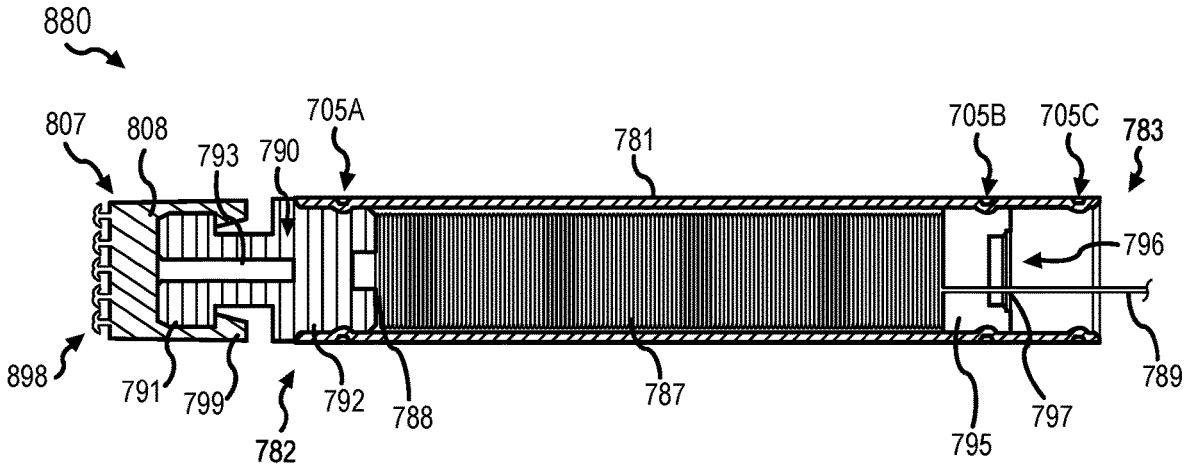

In various embodiments, and with reference to FIGS. 8A and 8B, a training electrode 880 is disclosed. Training electrode 880 (e.g., electrode 880) may be similar to any other electrode, projectile, or the like disclosed herein. For example, training electrode 880 may be substantially similar to electrode 780, with brief reference to FIGS. 7A-7C. For example, training electrode 880 may comprise an electrode body 781, a head 790, a rear nozzle 795, a filament 787, and one or more coupling points 795, as previously discuss with reference to FIGS. 7A-7C. Although depicted as comprising filament 787, in some embodiments a training electrode may not comprise filament 787.

As previously discussed, head 790 may be configured to receive one or more different attachments. Training electrode 880 may comprise a training head 807. Training head 807 may comprise an attachment configured to couple to head 790.

In various embodiments, training head 807 may comprise a body 808 (e.g., a training head body). Body 808 may be coupled to head 790. Body 808 may be coupled to head 790 using a mechanical coupling, a chemical coupling, and/or the like. Body 808 may be coupled to first head end 791. Body 808 may be coupled to head 790 forward second head end 792. Body 808 may be coupled to a T-shape defining first head end 791. Body 808 may comprise an outer surface radially outward an outer surface of head 790. Body 808 may comprise an aft inner surface that is radially inward from an outer surface of first head end 791 and second head end 792, but radially outward from an outer surface of a middle portion of head 790. The aft inner surface may be axially aft first head end 791 and axially forward second head end 792. In some embodiments, body 808 may be molded over head 790 such as, for example, using an injection molding process.

In various embodiments, body 808 may comprise an electrically non-conductive material, such as a rubber, a plastic, and/or the like. In that regard, body 808 may not be in electrical series with head 790 and/or filament 787.

In various embodiments, training head 807 may comprise a plurality of hooks 898 on a front surface of body 808. Each hook 898 may extend forward body 808. Hooks 898 may be configured to engage a surface of a target, such as, for example, clothing of a target, an article on a target, and/or the like. In some embodiments, hooks 898 may be configured to engage a surface of a target having a complimentary series of loops. Hooks 898 may engage the loops to couple electrode 880 to the target. In some embodiments, hooks 898 may comprise a series of hooks and loops. The series of hooks and loops may be configured to engage a surface of a target having a complimentary series of hooks and loops.

In various embodiments, training head 807 may comprise one or more retaining clips 899 (e.g., training retaining clip, accessory retaining clip, etc.) extending aft from body 808. Each retaining clip 899 may be configured to engage a surface of head 790. For example, a retaining clip 899 may be configured to engage a middle portion of head 790 between first head end 791 and second head end 792. As a further example, a retaining clip 899 may be configured to engage the T-shape defining first head end 791. A retaining clip 899 may comprise an axial extension from body 808. The axial extension may further comprise a radially inward protrusion. The radially inward protrusion may be configured to engage an inner surface of the T-shape defining first head end 791.

In various embodiments, body 808 may also comprise an axially aft extending portion proximate a centerpoint of body 808. The axially aft extending portion may be sized and shaped to be received in channel 893.

In various embodiments, a piston for a cartridge configured to deploy a projectile is disclosed. The piston may comprise a piston body having a first end opposite a second end; and a piston opening defined through the piston body from the first end to the second end, wherein the piston opening between the first end and the second comprises a smaller diameter than the piston opening proximate at least one of the first end or the second end.

In various embodiments of the above disclosed-piston, the piston opening proximate the first end may comprise a chamfered edge. The piston opening proximate the first end may be sized and shaped to receive a filament wire. The piston opening proximate the second end may be sized and shaped to receive a screw. The piston opening proximate the first end may be configured to receive a filament wire. The piston opening proximate the second end may comprise a recess sized and shaped to receive a screw and a washer. A first middle portion of the piston opening proximate the first end may comprise a greater diameter than a second middle portion of the piston opening proximate the second end. A middle outer diameter of the piston body between the first end and the second end may be greater than an end outer diameter of at least one of the piston body at the first end or the piston body at the second end.

In various embodiments, a cartridge is disclosed. The cartridge may comprise a cartridge body defining a piston stop on an inner surface of the cartridge body; a piston disposed within the cartridge body, wherein the piston is configured to travel forward during a deployment to contact the piston stop, wherein the piston is electrically coupled to the cartridge body before, during, and after the deployment; and a projectile disposed within the cartridge body forward the piston, wherein the projectile is electrically coupled to the piston.

In various embodiments of the above-disclosed cartridge, the projectile may remain electrically coupled to the piston before, during, and after the deployment. The projectile may comprise a wire-tether having a first end coupled to the projectile and a second end coupled to the piston. Before, during, and after the deployment the piston may be electrically coupled to the cartridge body at a radially outer surface of the piston. An axially forward surface of the radially outer surface of the piston may be configured to contact the piston stop during the deployment. The axially forward surface of the radially outer surface of the piston may be configured to electrically couple the piston to the piston stop. The piston may comprise a piston opening defined through the piston from a first piston end of the piston to a second piston end of the piston. The projectile may comprise a wire-tether having a first end coupled to the projectile and a second end inserted through the piston opening at the first piston end of the piston. A screw may be inserted through the second piston end of the piston, wherein the screw couples the second end of the filament to the piston. A washer may be coupled between the screw and the piston, wherein the washer is configured to electrically couple the second end of the filament to the piston. The washer may contact an inner surface of the piston opening. The washer may be configured to position the second end of the filament such that the second end of the filament contacts an inner surface of the piston opening.

In various embodiments, a piston for a cartridge configured to deploy a projectile is disclosed. The piston may comprise a piston body having a first end opposite a second end; a piston conductive body defining a first portion of the piston body, wherein the piston conductive body comprises an electrically conductive material; and a piston body overmold defining a second portion of the piston body, wherein the piston body overmold is configured to selectively expose a surface of the piston conductive body, and wherein the piston body overmold comprises an electrically non-conductive material.

In various embodiments of the above-disclosed piston, the piston body overmold may be coupled to an inner surface of the piston conductive body and an outer surface of the piston conductive body. The piston body overmold may surround the piston conductive body at the first end of the piston body. The piston body overmold may selectively expose the piston conductive body at the second end of the piston body. A piston opening may be defined through the piston body from the first end to the second end. The piston opening may be defined through the piston conductive body and the piston body overmold. The piston opening proximate the first end of the piston body may be defined through the piston body overmold, and wherein the piston opening proximate the second end of the piston body may be defined through the piston conductive body. The piston opening defined through the piston body overmold may comprise a smaller diameter than the piston opening defined through the piston conductive body. The piston opening defined through the piston body overmold at the first end of the piston body may comprise a chamfered edge. The piston overmold body may selectively expose an exposed surface of the piston conductive body, and wherein the exposed surface may comprise a portion of piston conductive body extending radially outward from the piston body. The exposed surface of the piston conductive body may comprise at least one of a radially outward surface or an axially forward surface. The piston overmold body may selectively expose a coupling point of the piston conductive body, and wherein the coupling point may comprise a portion of piston conductive body extending axially aft from the piston body. The coupling point may comprise a mechanical feature configured to couple the piston body to a retaining clip. The coupling point may be sized and shaped to receive a force from at least one of a propulsion module or a plug.

In various embodiments, a retaining clip for a cartridge inner assembly is disclosed. The retaining clip may comprise a clip body; a first clip end of the clip body configured to couple to a piston of the cartridge inner assembly; and a second clip end of the clip body configured to couple to a propulsion module of the cartridge inner assembly, wherein at least one of the first clip end or the second clip end are configured to decouple during a deployment of the cartridge inner assembly.

In various embodiments of the above-disclosed retaining clip, a retaining clip opening may be defined from the first clip end through to the second clip end. The retaining clip opening may be configured to enclose one or more components of the cartridge inner assembly before the deployment of the cartridge inner assembly. The retaining clip opening may be configured to at least partially enclose at least one of the piston or the propulsion module before the deployment of the cartridge inner assembly. The deployment the retaining clip opening may be configured to enclose a component of the cartridge inner assembly and at least partially enclose the piston and the propulsion module. The first clip end may be configured to mechanically or chemically decouple from the piston during the deployment. The second clip end may be configured to mechanically or chemically decouple from the propulsion module during the deployment.

In various embodiments, a cartridge inner assembly is disclosed. The cartridge inner assembly may comprise a piston; a propulsion module; and a retaining clip. The retaining clip may comprise a retaining clip body; a first clip end of the retaining clip body, wherein the first clip end is coupled to the piston; and a second clip end of the retaining clip body, wherein the second clip end is coupled to the propulsion module.

In various embodiments of the above-disclosed cartridge inner assembly, the piston may be at least partially enclosed by the retaining clip body at the first clip end. The propulsion module may be at least partially enclosed by the retaining clip body at the second clip end. A plug may be enclosed within the retaining clip body between the piston and the propulsion module. The first clip end of the retaining clip body may be configured to decouple from the piston in response to a deployment of the propulsion module. The second clip end of the retaining clip body may be configured to decouple from the propulsion module in response to a deployment of the propulsion module.

In various embodiments, a retaining clip for a cartridge is disclosed. The retaining clip may comprise a retaining clip body disposed within the cartridge, wherein retaining clip body comprise a first clip end opposite a second clip end; a piston clip defined on the first clip end, wherein the piston clip is configured to mechanically engage a piston disposed within the cartridge; and a propulsion module clip defined on the second clip end, wherein the propulsion module clip is configured to mechanically engage a propulsion module disposed within the cartridge.

In various embodiments of the above-disclosed retaining clip, at least one of the piston clip or the propulsion module clip may comprise a plurality of mechanical grips. The piston clip may comprise a portion of the first clip end extending at least one of axially forward the retaining clip body or radially inward the retaining clip body. The propulsion module clip may comprise a portion of the second clip end extending at least one of axially aft the retaining clip body or radially inward the retaining clip body. The piston clip may be circumferentially offset from the propulsion module clip. At least one of the piston clip or the propulsion module clip may comprise a frangible material configured to break during a deployment of the propulsion module. At least one of the piston clip or the propulsion module clip may comprise a plurality of circumferentially offset mechanical grips.

In various embodiments, a cartridge inner assembly is disclosed. The cartridge inner assembly may comprise a propulsion module configured to provide a propulsive force during a deployment; a piston configured to travel forward during the deployment; and a plug configured to transfer the propulsive force from the propulsion module to the piston. The plug may comprise a plug body; a first plug end of the plug body, wherein the first plug end is configured to insert within the piston; and a second plug end of the plug body, wherein the second plug end is configured to at least partially enclose the propulsion module.

In various embodiments of the above-disclosed cartridge inner assembly, the first plug end may comprise a smaller diameter than the second plug end. The piston may comprise a piston body having a first end opposite a second end; a piston opening defined through the piston body from the first end to the second end; and a screw coupled within the piston body. The first plug end of the plug body may be configured to insert within the piston opening. The first plug end of the plug body may be positioned within the piston opening proximate the screw. The first plug end of the plug body may be configured to transfer the propulsive force to a shoulder of the second end of the piston body circumferentially defining the piston opening. The second plug end of the plug body may comprise a recessed surface defining a circumferential edge extending axially aft the recessed surface. The recessed surface may be configured to contact the propulsion module while the circumferential edge is configured to at least partially enclose the propulsion module. The plug may comprise an electrically non-conductive material.

In various embodiments, a plug for a cartridge of a conducted electrical weapon is disclosed. The plug may comprise a plug body; a first end of the plug body; and a second end of the plug body, wherein the first end of the plug body comprises a smaller diameter than the second end of the plug body, and wherein the second end of the plug body comprises a recessed surface defining a circumferential edge extending axially aft the recessed surface.

In various embodiments of the above-disclosed plug, the plug may comprise a cylindrical shape. The plug may comprise an electrically non-conductive material. The plug may comprise a rubber material. The first end of the plug body may be sized and shaped to be received within a piston. The second end of the plug body may be sized and shaped to at least partially enclose a propulsion module.

In various embodiments, a cartridge for a less-lethal weapon may comprise a cartridge body defining a piston stop on an inner surface of the cartridge body; a propulsion module configured to provide a propulsive force during a deployment; a piston disposed within the cartridge body, wherein the piston is configured to travel forward during the deployment to contact the piston stop; and a plug configured to transfer the propulsive force from the propulsion module to the piston. The plug may comprise a plug body; a first plug end of the plug body, wherein the first plug end is configured to insert within the piston; and a second plug end of the plug body, wherein the second plug end is configured to contact the propulsion module.

In various embodiments of the above-disclosed cartridge, the plug may be coupled to the piston and configured to travel forward with the piston during the deployment. The plug may be coupled to the propulsion module and configured to remain with the propulsion module during the deployment. The plug may comprise a shape complimentary with the cartridge body. A retaining clip may be coupled to the piston and the propulsion module, wherein the retaining clip may enclose the plug.

In various embodiments, a cartridge body may comprise a first end opposite a second end; an elongated portion defined at the first end; a wide portion defined at the second end; a first step defined between the elongated portion and the wide portion; and a second step defined on the elongated portion between the first end and the first step.

In various embodiments of the above-disclosed cartridge body, the wide portion may comprise a greater diameter than the elongated portion. A first portion of the elongated portion from the first step to the second step may comprise a greater outer diameter than a second portion of the elongated portion from the second step to the first end. A first diameter of the wide portion may be greater than a second diameter of the first portion of the elongated portion and a third diameter of the second portion of the elongated portion. An inner diameter of the elongated portion may remain consistent from the first end to the first step. An inner diameter of the wide portion may remain consistent from the first step to the second end. The wide portion at the second end may be sized and shaped to removably receive a cartridge inner assembly.

In various embodiments, a cartridge for a less-lethal weapon is disclosed. The cartridge may comprise a cartridge body having a first end opposite a second end; a cartridge inner assembly removably disposed within the cartridge body proximate the second end of the cartridge body; a projectile disposed forward the cartridge inner assembly within the cartridge body; and a blast door coupled to the second body portion of the cartridge body. The cartridge body may comprise a first body portion comprising a first outer diameter; and a second body portion comprising a second outer diameter, wherein the first outer diameter is smaller than the second outer diameter.

In various embodiments of the above-disclosed cartridge, the cartridge body may comprise an elongated portion and a wide portion, wherein the elongated portion may be defined by the first body portion and the second body portion, and wherein the wide portion may be defined by a third body portion. The third body portion may comprise a third outer diameter, and wherein the third outer diameter may be greater than the first outer diameter and the second outer diameter. The first body portion may comprise a first inner diameter, the second body portion may comprise a second inner diameter, and the third body portion comprises a third inner diameter, and wherein the third inner diameter may be greater than each of the first inner diameter and the second inner diameter. The first inner diameter may be substantially similar to the second inner diameter. The blast door may comprise a blast door width, the first body portion may comprise a first width, and the second body portion may comprise a second width, and wherein the second width may be greater than each of the first width and the blast door width. The blast door width and the first width together may be substantially similar to the second width. The blast door width and the first width together may be smaller than the second width. The cartridge body may comprise an opening defined from the first end through the second end, wherein the blast door may obstruct the opening at the first end. The blast door may be coupled to the first body portion and may extend axially aft towards the second body portion. The blast door may be configured to decouple from the first body portion during a deployment.

In various embodiments, a cartridge body may comprise a first body portion comprising a first outer diameter; a second body portion comprising a second outer diameter; and a third body portion comprising a third outer diameter, and wherein each of the first outer diameter, the second outer diameter, and the third outer diameter are different.

In various embodiments of the above-disclosed cartridge body, the third outer diameter may be greater than the first outer diameter and the second outer diameter. The first outer diameter may be smaller than the second outer diameter. The first body portion may comprise a first inner diameter, the second body portion may comprise a second inner diameter, and the third body portion may comprise a third inner diameter, and wherein the third inner diameter may be greater than the first inner diameter and the second inner diameter. The first inner diameter may be the same as the second inner diameter. The first body portion and the second body portion may define an elongated body, and wherein the third body portion may define a wide body. The elongated body between the first body portion and the second body portion may define a step. A step may be defined between the elongated body and the wide body. Each of the first body portion, the second body portion, and the third body portion may be cylindrically shaped.

In various embodiments, an electrode for a conducted electrical weapon may comprise an electrode body having a first body end opposite a second body end; and an electrode head comprising a first head end opposite a second head end, wherein the electrode head defines a middle portion between the first head end and the second head end, wherein the second head end is coupled to and disposed within the first body end, wherein the middle portion is forward the first body end, and wherein the middle portion comprises a middle portion diameter less than a first diameter of the first head end and a second diameter of the second head end.

In various embodiments of the above-disclosed electrode, the first diameter may be less than the second diameter. An attachment may be coupled to the middle portion of the electrode head. A thickness of the attachment and the middle portion diameter together may be less than the second diameter. A thickness of the attachment and the middle portion diameter together may be substantially similar to the second diameter. The attachment may contact the first head end and the middle portion, and wherein the attachment may comprise a first thickness proximate the first head end and a second thickness proximate the middle portion. The first thickness and the first diameter may be substantially similar in size to the second thickness and the middle portion diameter. At least one of the first thickness and the first diameter or the second thickness and the middle portion diameter may be smaller in size than the second diameter. At least one of the first thickness and the first diameter or the second thickness and the middle portion diameter may be substantially similar in size to the second diameter. The electrode head may comprise an hourglass shape.

In various embodiments, an electrode for a conducted electrical weapon may comprise an electrode body having a first body end opposite a second body end; an electrode head coupled to the first body end; a rear nozzle disposed within the electrode body forward the second body end; and a plurality of coupling points defined on the electrode body, the plurality of coupling points comprising a first coupling point coupling the electrode body to the electrode head, a second coupling point coupling the electrode body to the rear nozzle, and a third coupling point configured to couple the electrode body to a piston.

In various embodiments of the above-disclosed electrode, the first coupling point may be proximate the first body end, the third coupling point may be proximate the second body end, and the second coupling point may be between the first body end and the second body end. The second coupling point may be closer to the third coupling point than the first coupling point. Each of the electrode head, the rear nozzle, and the piston may be at least partially disposed within the electrode body. The third coupling point may be configured to decouple during a deployment. The first coupling point and the second coupling point may be configured to remain coupled before, during, and after a deployment. The first coupling point may be configured to decouple in response to a force of impact. One or more of the plurality of coupling points may comprise a press fit coupling. One or more of the plurality of coupling points may comprise a portion of the electrode body deformed radially inward. One or more of the plurality of coupling points may comprise a protrusion extending radially inward from an inner surface of the electrode body.

In various embodiments, an electrode for a conducted electrical weapon may comprise an electrode body having a first body end opposite a second body end; an electrode head coupled to the first body end, wherein the electrode head comprises a first head end opposite a second head end; and an attachment coupled to a radially outer surface of the electrode head between the first head end and the second head end.

In various embodiments of the above-disclosed electrode, the attachment may be further coupled to the first head end. The attachment may comprise an absorber configured to at least partially receive a force of impact. The attachment may further comprise a spear. The electrode head may comprise varying diameters across the radially outer surface, and wherein the attachment may be coupled to the electrode head across the varying diameters. The first head end may comprise a first diameter, the second head end may comprise a second diameter, and a middle portion between the first head end and the second head end may comprise a middle diameter, and wherein the middle diameter may be smaller than each of the first diameter and the second diameter. The attachment may comprise an aft inner surface that is radially inward from the first head end. The aft inner surface of the attachment may be radially outward from the middle portion. The aft inner surface of the attachment may be axially forward the second head end. The attachment may comprise a training head. The training head may comprise a plurality of hooks on a front surface of the training head. The training head may comprise a retaining clip configured to engage a middle portion of the electrode head between the first head end and the second head end. The electrode head may comprise a channel defined at the first head end, and wherein the attachment may cover the channel. The attachment may comprise a first attachment and a second attachment. The first attachment may be coupled to a forward surface of the first head end, and wherein the second attachment may be coupled to the radially outer surface of the electrode head between the first head end and the second head end. The first attachment may comprise an electrically conductive material, and wherein the second attachment may comprise an electrically non-conductive material. The first attachment may comprise a spear, and wherein the second attachment may comprise an absorber.

In various embodiments, a cartridge for a conducted electrical weapon may comprise a cartridge body; a piston disposed within the cartridge body; and an electrode disposed within the cartridge body forward the piston. The electrode may comprise an electrode body having a first end opposite a second end; and an electrode head coupled to the first end, wherein a portion of the piston is disposed within the second end, and wherein the second end of the electrode body is coupled to the piston.

In various embodiments of the above-disclosed cartridge, the cartridge body may comprise a piston stop, wherein the piston may be configured to contact the piston stop during a deployment, and wherein in response to the piston contacting the piston stop the electrode body may be configured to decouple from the piston. The electrode may comprise a filament comprising a first filament end opposite a second filament end, wherein the first filament end may be coupled to the electrode head, and wherein the second filament end may be coupled to the piston. The second filament end may remain coupled to the piston before, during, and after a deployment. The electrode head, the filament, the piston, and the cartridge body may be in electrical series.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A piston for a cartridge configured to deploy a projectile for a conducted electrical weapon, the piston comprising:

a piston body having a first end opposite a second end, wherein the piston body is configured to travel within the cartridge to cause deployment of the projectile; and a piston opening defined through the piston body from the first end to the second end, wherein the piston opening between the first end and the second end comprises a smaller diameter than the piston opening proximate at least one of the first end or the second end.

2. The piston of claim 1, wherein the piston opening proximate the first end is sized and shaped to receive a filament wire.

3. The piston of claim 1, wherein the piston opening proximate the second end is sized and shaped to receive a screw.

4. The piston of claim 3, wherein the piston opening proximate the first end is configured to receive a filament wire.

5. The piston of claim 1, wherein the piston opening proximate the second end comprises a recess sized and shaped to receive a screw and a washer.

6. The piston of claim 1, wherein the piston opening defines a middle portion between the first end and the second end, and wherein the middle portion comprises varying dimensions.

7. The piston of claim 6, wherein the middle portion comprises a first middle portion proximate the first end and a second middle portion proximate the second end, and wherein the first middle portion is wider than the second middle portion.

8. The piston of claim 1, wherein the piston opening proximate the second end comprises a greater diameter compared to the piston opening proximate the first end.

9. The piston of claim 1, wherein the piston opening is configured to receive a filament wire.

10. The piston of claim 9, wherein the filament wire is configured to extend into the piston opening between the first end and the second end.

11. A cartridge configured for a conducted electrical weapon:

a cartridge body;

a piston disposed within the cartridge body, wherein the piston comprises:

a piston body having a first end opposite a second end; and a piston opening defined through the piston body from the first end to the second end, wherein the piston opening comprises varying dimensions from the first end to the second end; and a projectile disposed within the cartridge body at least partially forward the piston, wherein the piston body is configured to travel within the cartridge body to cause deployment of the projectile.

12. The cartridge of claim 11, wherein the projectile is electrically coupled to the piston.

13. The cartridge of claim 12, wherein the projectile remains electrically coupled to the piston before, during, and after a deployment of the projectile.

14. The cartridge of claim 12, further comprising a filament wire comprising a first filament end opposite a second filament end, wherein the first filament end is coupled to the projectile, and wherein the second filament end is coupled to the piston.

15. The cartridge of claim 14, wherein the second filament end is positioned within the piston opening.

16. The cartridge of claim 15, further comprising a screw inserted into the piston opening at the second end, wherein the screw is configured to couple the second filament end to the piston.

17. A piston for a cartridge configured to deploy a projectile for a conducted electrical weapon, the piston comprising:

a piston body having a first end opposite a second end, wherein the first end is configured to couple to the projectile, and wherein the piston body is configured to travel within the cartridge to cause deployment of the projectile;

a piston opening defined through the piston body from the first end to the second end, wherein the piston opening comprises varying dimensions from the first end to the second end; and a screw inserted into the piston opening at the second end.

18. The piston of claim 17, wherein the first end is sized and shaped to be received within the projectile.

19. The piston of claim 17, wherein the piston opening proximate the second end defines a recess, and wherein the screw is positioned within the recess.

20. The piston of claim 17, wherein the piston opening proximate the first end is configured to receive a filament wire, and wherein the screw is configured to couple the filament wire to the piston body.

* * * * *